US007866500B1

(12) United States Patent
Peggs

(10) Patent No.: US 7,866,500 B1
(45) Date of Patent: Jan. 11, 2011

(54) COLLAPSIBLE POLYMERIC BELLOWS STORAGE TUBE

(76) Inventor: John David Peggs, 636 Solar Isle Dr., Fort Lauderdale, FL (US) 33301-2628

( * ) Notice: Subject to any disclaimer, the term of this patent is extended or adjusted under 35 U.S.C. 154(b) by 717 days.

(21) Appl. No.: 11/848,176

(22) Filed: Aug. 30, 2007

(51) Int. Cl.
*B65D 21/032* (2006.01)

(52) U.S. Cl. ..... 220/6; 220/666; 220/4.26; 220/529

(58) Field of Classification Search ..... 220/4.26, 220/666, 529, 527, 916, 6; 215/900
See application file for complete search history.

(56) References Cited

U.S. PATENT DOCUMENTS 197,760 A * 12/1877 Brewer ..... 220/504
2,432,025 A * 12/1947 Lorenz ..... 137/590
2,962,187 A * 11/1960 Morris ..... 220/780
3,311,129 A * 3/1967 Binder ..... 137/578
4,955,493 A * 9/1990 Touzani ..... 215/372
5,199,590 A * 4/1993 Grandahl et al. ..... 220/222
2006/0065590 A1* 3/2006 Scharf ..... 210/460

* cited by examiner

*Primary Examiner*—Stephen Castellano
(74) *Attorney, Agent, or Firm*—Michael I Kroll

(57) ABSTRACT

A bellows design collapsible polymeric storage tube. The device incorporates separate flexible plastic disks as segregating spacers that are dropped inside the device creating separate spaces for a plurality of items. The spacers lock into the widest part of the bellows securing them in place. The disks are printable/markable for promotional/informative media and labeling. In a first instance of the bellows receptacle, the collapsible bellows tube consists of two threaded ends and two threaded lids. The lids pop open and have their own separate space(s) that also uses a disk to create a separate segregated compartment. When a lid is empty the top of the lid collapses in upon itself thus saving space when the lid is empty and packed away, likewise the body of the tube collapses and expands as it is filled or emptied of the contents inside in order to save space when it is packed away. In a second instance of the present invention, the bellows receptacle uses a pair of segregating discs with each positioned approximate the top and bottom of the bellows receptacle forming closure for said receptacle. Any number of additional discs can be used to create segregated compartments within said bellow receptacle.

20 Claims, 30 Drawing Sheets

COLLAPSIBLE POLYMERIC BELLOWS STORAGE TUBE

BACKGROUND OF THE INVENTION

1. Field of the Invention

The present invention relates generally to storage devices and, more specifically, to a bellows design collapsible polymeric storage tube having two lids. The device incorporates separate flexible plastic disks as segregating spacers that are dropped inside the device creating separate spaces for a plurality of items. The spacers lock into the widest part of the bellows securing them in place. The disks are printable/markable for promotional/informative media and labeling. The collapsible bellows tube consists of two threaded ends and two threaded lids. The lids pop open and have their own separate space (s) that also uses a disk to create a separate segregated compartment. When a lid is empty the top of the lid collapses in upon itself thus saving space when the lid is empty and packed away, likewise the body of the tube collapses and expands as it is filled or emptied of the contents inside in order to save space when it is packed away.

Additionally, the separation disks can be used to form liquid tight segregated compartments with the addition of peripheral gasket.

Furthermore, the present invention provides for a bellows receptacle having no exteriorly attachable lids, instead a pair of segregation discs are position within the bellows receptacle body approximate the top and bottom ends and constrained thereby serving as bellows receptacle closure.

2. Description of the Prior Art

There are other storage devices designed for similar purposes. Typical of these is U.S. Pat. No. 1,048,935 issued to Brady on Dec. 31, 1912

Another patent was issued to Wiswell on Dec. 6, 1938 as U.S. Pat. No. 2,139,143. Yet another U.S. Pat. No. 2,685,316 was issued to Krasno on Aug. 3, 1954 and still yet another was issued on May 12, 1959 to Davison as U.S. Pat. No. 2,886,084. Another U.S. Pat. No. 2,899,110 was issued to Parker on Aug. 11, 1959.

Another patent was issued to Stracey on Nov. 3, 1964 as U.S. Pat. No. 3,155,281. Yet another U.S. Pat. No. 3,285,459 was issued to Gahm on Nov. 15, 1966. Another was issued to Santelli on Jan. 31, 1967 as U.S. Pat. No. 3,301,293 and still yet another was issued on Mar. 25, 1969 to Valtri, et al. as U.S. Pat. No. 3,434,589.

Another patent was issued to Markowitz on Sep. 3, 1974 as U.S. Pat. No. 3,833,154. Yet another U.S. Pat. No. 3,939,887 was issued to Scarnato on Feb. 24, 1976. Another was issued to Martin, et al. on Aug. 30, 1977 as U.S. Pat. No. 4,044,836 and still yet another was issued on May 27, 1980 to Graves as U.S. Pat. No. 4,204,611.

Another patent was issued to Keffeler on Feb. 8, 1983 as U.S. Pat. No. 4,372,445. Yet another U.S. Pat. No. 4,381,059 was issued to Schurman on Apr. 26, 1983. Another was issued to Hollenbeck on Jul. 26, 1983 as U.S. Pat. No. 4,394,906 and still yet another was issued on Jan. 8, 1985 to Touzani as U.S. Pat. No. 4,492,313.

Another patent was issued to Keffeler on Apr. 5, 1988 as U.S. Pat. No. 4,735,318. Yet another U.S. Pat. No. 4,749,085 was issued to Denney on Jun. 7, 1988. Another was issued to Halbich on Dec. 27, 1988 as U.S. Pat. No. 4,793,492 and still yet another was issued on Mar. 7, 1989 to Albright as U.S. Pat. No. 4,809,877.

Another patent was issued to Dirksing, et al. on Oct. 10, 1989 as U.S. Pat. No. 4,873,100. Yet another U.S. Pat. No. 4,875,576 was issued to Torgrimson, et al. on Oct. 24, 1989.

Another was issued to Hornstein on Jul. 10, 1990 as U.S. Pat. No. 4,940,138 and still yet another was issued on Sep. 11, 1990 to Touzani as U.S. Pat. No. 4,955,493.

Another patent was issued to Touzani on Mar. 26, 1991 as U.S. Pat. No. 5,002,193. Yet another U.S. Pat. No. 5,201,438 was issued to Norwood on Apr. 13, 1993. Another was issued to Osbakk on Aug. 31, 1993 as U.S. Pat. No. 5,240,130 and still yet another was issued on Dec. 14, 1993 to Gilbert as U.S. Pat. No. 5,269,428.

Another patent was issued to Crowther on Jun. 21, 1994 as U.S. Pat. No. 5,322,166. Yet another U.S. Pat. No. 5,549,213 was issued to Robbins, III, et al. on Aug. 27, 1996. Another was issued to Weiss, et al. on Jul. 21, 1998 as U.S. Pat. No. 5,782,372 and still yet another was issued on Aug. 22, 2000 to Mazda as U.S. Pat. No. 6,105,815.

Another patent was issued to Kogen on Oct. 3, 2000 as U.S. Pat. No. 6,126,010. Yet another U.S. Pat. No. 6,202,224 was issued to Freeman on Mar. 20, 2001. Another was issued to Holmberg on Sep. 25, 2001 as U.S. Pat. No. 6,293,403 and still yet another was issued on May 18, 2004 to Stewart-Stand as U.S. Pat. No. 6,736,285.

Another patent was issued to Weder on May 31, 2005 as U.S. Pat. No. 6,898,899. Yet another U.S. Pat. No. 7,004,324 was issued to Delorio on Feb. 28, 2006. Another was issued to Hutt on Jul. 20, 1928 as UK Patent No. GB294,187 and still yet another was issued on Dec. 8, 1943 to Cow as UK Patent No. GB557,857. Another was issued to Gahm on Aug. 28, 1968 as UK Patent No. GB 1,125,488 and still yet another was issued on Dec. 31, 2002 to Miller as UK Patent No. GB 2 376 877.

U.S. Pat. No. 1,048,935

Inventor: John F. Brady

Issued: Dec. 31, 1912

A drinking cup embodying a base plate with a marginal bead, a collapsible cup on said base plate, a housing member inclosing the cup and comprising a body portion with a side provided near its marginal edge with a resilient internal curved flange forming a seat for said bead, and means for releasing said bead from its seat comprising a spring plate having a portion secured to the inner face of said body and a releasing wedge movable with said spring plate and having a portion projecting through the side wall of the housing.

U.S. Pat. No. 2,139,143

Inventor: Norman N. Wiswell

Issued: Dec. 6, 1938

A container having a foldable side wall of readily bendable and collapsible material creased over substantially the entire length of the container with a plurality of substantially parallel fold initiating creases extending around the side wall, said creases having a plurality of intermissions which occur at several points about the circumference of the wall, all in such manner that the container may be substantially collapsed by endwise pressure, with the side wall material between said parallel creases, and also at the intermissions in each crease, bending reversely to the direction of deformation of said fold initiating creases.

U.S. Pat. No. 2,685,316

Inventor: Louis R. Krasno

Issued: Aug. 3, 1954

A container for perishable products comprising a body including a bottom wall, spaced parallel side walls, and connecting flexible end walls, a flexible filling neck carried by the upper ends of the side and end walls, and a removable sealing closure for the neck, and connecting end walls being provided with vertically extending accordion pleats running from the bottom wall to the neck, whereby the connecting end walls can be collapsed upon pressure being applied to the side walls for bringing said side walls 5 toward one another.

U.S. Pat. No. 2,886,084

Inventor: Delphine L. Davison

Issued: May 12, 1959

A portable container including a base, a top, and an upright accordion-like wall structure of pliable, moisture-proof material connected at its lower end to the base and at the upper end to said top, the wall structure including an accordion-like inner wall and a similar outer wall in a spaced relation to said inner wall, coil spring means in the space between the inner wall and the outer wall, the spring means bearing at the lower end against said base and bearing at the upper end against said top, and urging the top in a direction away from the base, the top being provided with a central aperture opening into the space surrounded by the inner wall, air valve means in the top for passage of air into or out of the space between the outer wall and the inner wall, and a removable closure for the aperture in said top, the accordion-like wall structure being adapted to be collapsed against the resistance of the spring means by manual pressure upon the top towards the base.

U.S. Pat. No. 2,899,110

Inventor: Carol Parker

Issued: Aug. 11, 1959

A dispensing container comprising a generally circular top, a generally circular bottom. and a generally conical side wall of flexible resilient material connecting the peripheral portions of said top and bottom, said side walls comprising a plurality of side by side integrally formed pleats, each of said pleats consisting of an inwardly and upwardly sloping upper strip wall and an inwardly and downwardly sloping lower strip walls of each pleat intersecting to define an outwardly projecting hinged connection, and the inner edges of the strip walls of said pleats intersecting to define an inwardly projecting hinged connection, said strip walls being approximately flat in transverse direction and being adapted to be brought into close face to face relation by the action of said hinged connections without exceeding the elastic limit thereof in response to collapsing movement applied to said top and bottom the degree of conicity of said walls being sufficient to permit said inwardly projecting hinged connections to substantially contact said bottom when said container is collapsed.

U.S. Pat. No. 3,155,281

Inventor: John Stracey

Issued: Nov. 3, 1964

A novel container for powders, pastes, and liquids, comprising a mini chamber having a substantially flexible resilient wall member in the form of a continuous helical bellows biased to expand position by the inherent resiliency of said wall member, a base open at the top and having an inner side wall having a larger diameter than said wall member, a closed bottom and internal threads on said base spaced upwardly from said bottom and spaced inwardly from said inner side wall, said internal threads cooperating with the lower end of said resilient wall member to connect said base to said wall member, said wall member being adapted to be screwed into and thereby collapsed within said base, the upper end of said chamber being provided with means for dispensing the contents of said chamber.

U.S. Pat. No. 3,285,459

Inventor: Wilbert J. Gahm

Issued: Nov. 15, 1966

In a collapsible multicompartment container, the combination comprising: a base member, a vertically oriented circumferential wall extending upwardly from said base at right angles thereto to define a cup-shaped portion, a second wall attached to said base within said circumferential wall and coaxial therewith, said second wall extending angularly upwardly and outwardly from said base and defining a second cup-shaped portion, a plurality of rings of progressively larger diameter than said second wall at its point of interconnection with said base which may be elevated progressively to engage each other and said second wall to define a receptacle of increasing diameter, a complementary cover for said container including a top portion and downwardly extending side wall portions, frictionally cooperable with said circumferential wall on said base to define a container therewith, said cover portion further including a second wall extending vertically downwardly from said top in parallel relation to said side wall portions to define an inverted container within said cover, a closure member for said cover container including an upwardly directed side wall portion adapted to frictionally embrace said second wall of said cover container, said closure member having a diameter greater than the inner diameter of said second cup-shaped portion in said base at the point of interconnection of said second wall and said base but lesser than the inner diameter of said second cup-shaped portion at its uppermost extremity, whereby said closure member will be retained in position on said wall of said cover container by said wall of said second cuo-shaped portion in said base when said cover and said base are interconnected, and indicating indicia on said closure member and said wall of said cover container to indicate times for use of materials contained within said cover container.

U.S. Pat. No. 3,301,293

Inventor: Thomas R. Santelli

Issued: Jan. 31, 1967

A collapsible container comprising opposite top and bottom walls and a flexible side wall interconnecting said top and bottom walls to enclose a space, said side wall having a plurality of longitudinally spaced bellows-like pleats each defined by a ridge and outwardly extending wall portions converging at the ridge, and interlocking means formed on a number of adjacent pairs of said pleats for retaining the container in any selected one of a plurality of collapsed positions, U.S. Pat. No. 3,434,589

Inventor: Frank J. Valtri, et al.

Issued: Mar. 25, 1969

A throw-away personel-use container of resilient plastic material comprising (a) a compressible-expandable cup; said cup having a bottom, an annular wall, and a removable cap;

(b) said cup having a bottom, an annular wall, and a removable cap;

(c) said annular wall alternately decreasing and increasing diametrically, forming accordion-like folds;

(d) said bottom being provided with a pair of individual well each of a size and shape adapted for receiving with clearance an individual tablet or pellet;

(e) said cap, when said cup is fully compressed, closing each well to retain the tablet therein; and (f) means retaining said cup in fully compressed condition pending use of said tablets.

U.S. Pat. No. 3,833,154

Inventor: Isral J. Markowitz

Issued: Sep. 3, 1974

A collapsible dispensing container wherein a container body is provided with an opening having a discharge member engaged over the opening, and in the opening is a one-way valve resiliently biased to permit fluent material movement outwardly upon collapse of the container body and prevent fluent material entry to the body.

U.S. Pat. No. 3,939,887

Inventor: Thomas J. Scarnato

Issued: Feb. 24, 1976

A self-expandable, foldable and reusable container made of elastic material which is adapted to be collapsed progressively from top to bottom to a volumetric dimension substantially equal to the substance contained therein to minimize air space in the container. An air tight closure is tightened about an access opening in said container while the same is held in collapsed condition. The folds of said container are formed with sections of different geometry to effect progressive flexibility from the top to the bottom thereof.

U.S. Pat. No. 4,044,836

Inventor: Edward J. Martin

Issued: Aug. 30, 1977

A dispenser for dry powders, and in particular for fire extinguishing powders, formed as a container having a handle/nozzle section to be gripped by one hand, a hand gripping section to be gripped by the other hand, and a central bellows section for alternate axial compression and expansion to pump the powder from the container and thereby to discharge it in repeated cloud-like bursts. By regulating the quantity of powder in the dispenser and the powder dispensing opening it is possible to repeatedly discharge fire extinguishing effective amounts of a fire extinguishing powder. In one preferred embodiment the handle/nozzle section is configured as an elongated conical member.

U.S. Pat. No. 4,204,611

Inventor: Joel S. Graves

Issued: May 27, 1980

A product dispenser for dispensing products, such as tablets, on a time related schedule, or randomly as desired, comprising a generally cylindrical product receiving magazine having a plurality of axially spaced groups of circumferentially spaced, radially outwardly opening, product receiving pockets which are generally in axial alignment with the pockets of adjacent groups to form circumferentially spaced rows of pockets; a plurality of product retaining rotatable rings mounted on the magazine in radial alignment with the pockets for retaining the tablets in the pockets; each ring including a tablet dispensing aperture therethrough adapted to be moved into alignment with a selected one of the pockets; a plurality of axially spaced indicia, representing the days of the week, lying in the planes of the groups of pockets; and circumferentially spaced indicia, representing different time periods throughout the day, generally longitudinally aligned with the rows of pockets.

U.S. Pat. No. 4,372,445

Inventor: Paul J. Keffeler

Issued: Feb. 8, 1983

A medication dispenser includes a container defining a plurality of open topped medication compartments adapted to be closed by a compartment cover assembly including a plurality of individual covers connected together by fracturable links. Each cover includes an integral fracturable tab depending from one end and coacting means on the container and tabs for securing the tabs in snap-fit relation when the cover is positioned to close its respective compartment. Thus each tab is independently secured relative to the container and fractured from its respective cover in response to upward movement of the opposite end of the cover to open the compartment.

U.S. Pat. No. 4,381,059

Inventor: Edwin A. Schurman

Issued: Apr. 26, 1983

Easy opening article storing and dispensing containers and method in which puzzle-like locking means secure against access to the container contents by very young children by obscuring the mode of opening it. The cannular container shell has closable dispensing aperture means opening through the shell side wall. Locking means at one or more ends of the shell optionally prevents or permits opening and closing of the container by alignment or offset of release means with respect to a sliding means. Pills or other units may be segregated in separate amounts or dosages within the container and dispensed in predetermined sequence from a plurality of rings of radially openable compartments forming a stack in which rows of compartments around the container axis can be rotated to sequentially register with the aperture means and compartments of each row sequentially opened.

U.S. Pat. No. 4,394,906

Inventor: John C. Hollenbeck

Issued: Jul. 26, 1983

Food container/holder formed from foamed polymer and having a body portion of ascending corrugated bands for extruding food under hand pressure.

U.S. Pat. No. 4,492,313

Inventor: William Touzani

Issued: Jan. 8, 1985

A collapsible or foldable plastic bottle of circular bellows like configuration capable of manufacture on current plastic bottle manufacturing equipment with current plastic materials approved for contact with foods and beverages. The bellows over center and fold to retain the folded condition without external assistance thus providing a self-latching feature. In particular, the bellows of the bottle, when fully folded, cause the bottle to substantially fit within a cup fastened to the base of the bottle. The cup is generally formed by further extending the cup upward and increasing the diameter slightly in comparison with the reinforcing cup on current soda pop bottles.

U.S. Pat. No. 4,735,318

Inventor: Paul J. Keffeler

Issued: Apr. 5, 1988

A medication dispenser includes a reusable container adapted to receive one or more disposable multicompartment liners for sanitary storage of medication out of contact with the reusable container. The open-topped compartments of the liners are closed by individual covers which are locked onto the container with a fracturable tab which must be broken to open a compartment. Each cover has a depending peripheral flange adapted for insertion into a peripheral channel around each compartment of the liner to form an air-tight seal for tamper-proof sanitary airtight storage of a patient's medication.

U.S. Pat. No. 4,749,085

Inventor: James D. Denney

Issued: Jun. 7, 1988

A rectangular, open-top shallow tray with enclosing side walls has markings designating each day of the week equally spaced across the top and a set of individual compartments or pill boxes for each day of the week resting in the tray in line with each of the designated days of the week and frictionally and removably held in place in the tray so that each of the set of pill boxes can be separately and individually removed from the tray whereby the user can conveniently carry prescribed medication for a given day separate from the other days of the week.

U.S. Pat. No. 4,793,492

Inventor: Frank Halbich

Issued: Mar. 7, 1989

An improved homecare pillbox containing a plurality of compartments for pills or the like arranged, indexed and differentiated in units for use over a selected period of time such as a week, and for providing proper medication in accurate doses to patients, whether supervised or unsupervised; readily releasable means for securing together any number of such units for holding several types of medication to be taken at different times during the day; and cover means for easy opening and access and for storing and protecting medication.

U.S. Pat. No. 4,809,877

Inventor: Marie O. Albright

Issued: Mar. 7, 1989

A device for dispensing medicament capsules is set forth which includes a housing within which are disposed a plurality of vertically spaced and substantially parallel transverse dispensing gates. Each dispensing gate has a like number of apertures extending vertically through the gate and spaced at different radial distances from the housing axis where the radial distances are of equal length in each one of the plurality of gates. Those apertures located at equal radial distances in successive dispensing gates are spaced in a radial sequence of equal angles. Between each successive dispensing gate a removable and reloadable carriage member is located which is contiguous with the dispensing gate and each carriage member has a multiplicity of radially spaced slots extending vertically through the carriage member for storage of medicament capsules. The slots are sequentially located concentrically about the vertical axis at radial distances equal to those radial distances locating a dispensing gate aperture. The carriage members are connected together to permit vertical alignment of the carriage member slots such that upon rotation of the carriage members, the slots remain in vertical alignment. A programmable motor is also provided to index or rotate the carriage members whereby upon open alignment of any carriage member slot with a dispensing gate aperture the capsules contained in the slot will pass downwardly through the dispensing gate.

U.S. Pat. No. 4,873,100

Inventor: Robert S. Dirksing, et al.

Issued: Oct. 10, 1989

A bistable expandable bottle preferably including a concentrated material to be diluted, said bottle being comprised of convex shaped bellows when in its expanded condition, said bottle also including opposed handle means for facilitating the extension of the bottle from its collapsed to its expanded condition. In a preferred embodiment a self-venting closure is also employed to seal the orifice in said bottle to permit extension of the bottle from its collapsed to its expanded condition without loosening or removing of the closure.

U.S. Pat. No. 4,875,576

Inventor: Lee A. Torgrimson, et al.

Issued: Oct. 24, 1989

A mixing kit for beverages or other mixtures is disclosed. Such a kit includes a predetermined volume of a first substantially non-gaseous mixture component. The first mixture component is adapted for combination with a second liquid mixture component in a predetermined mixture ratio. A volume expandable enclosure is included for retaining the mixture components. The enclosure defines a predetermined condensed enclosure volume sufficient to retain the volume of the first mixture component, and a predetermined expanded enclosure mixture volume. The mixture volume is sufficient to retain both the first and second mixture components in the desired predetermined ratio.

U.S. Pat. No. 4,940,138

Inventor: Allan S. Hornstein

Issued: Jul. 10, 1990

A cylindrical tube having a removable end closure at a first end and a collapsible drinking cup inserted in a second end is provided as a storage container for miscellaneous items such as first aid components. In its collapsed state, the collapsible drinking cup functions as an end plug for the container and in its extended state, it is a liquid tight cup for use with the container contents.

U.S. Pat. No. 4,955,493

Inventor: William N. Touzani

Issued: Sep. 11, 1990

A collapsible plastic hollow article having a top and a base joined by a substantially cylindrical side wall integral therewith and an aperture in the top, comprising a plurality of substantially circular bellows formed by conical sections integrally joined to create at least a portion of the side wall, the conical sections comprising alternating short portions and long portions, said short portions being at a greater angle to the bottle axis than said long portions, and the lesser diameter junctures of the long portions with the short portions being formed to create fold rings for the substantially circular bellows, wherein means for connecting a suction cup to said base.

U.S. Pat. No. 5,002,193

Inventor: William N. Touzani

Issued: Mar. 26, 1991

A collapsible, expansible, plastic hollow article having a top and a base joined by a substantially cylindrical side wall integral therewith and an aperture in the top, comprising a plurality of substantially circular bellows formed by conical sections integrally joined to create at least a portion of the article side wall, the conical sections comprising alternating short portions and long portions, said short portions being at a greater angle to the article axis than said long portions, and the lesser diameter junctures of the long portions with the short portions being formed to create fold rings for said substantially circular bellows. A handle means comprising a clip snugly fits in between adjacent conical sections joined by a lesser diameter juncture, and a grip having a further support at a lower point of the side wall. Thus the hollow article can be held in a straight configuration.

U.S. Pat. No. 5,201,438

Inventor: Peter M. Norwood

Issued: Apr. 13, 1993

A multi-faceted collapsible container has a sidewall of joined-together rings comprised of pyramidal segments having peaks extending outwardly. Each segment is comprised of four polygonal facets; the upper pair of facets is longer than the lower pair. Sufficient vertical force causes the smaller lower facets to fold under the longer upper facets, collapsing the rings and the sidewall of the container.

U.S. Pat. No. 5,240,130

Inventor: Georg Osbakk

Issued: Aug. 31, 1993

A compressible body comprising a container and a flexible annular wall member, and the container, in turn, includes a cylindrical side wall and a prestressed locking member. The side wall of the container forms an upper edge and defines a cylindrical space having a given circumference, and the locking member of the container is mounted on the upper edge of the side wall and is inherently biased radially inwardly toward a position inward of that given circumference. The wall member of the bottle is mounted inside the container of the bottle, and that wall member has extended and compressed positions. In the extended position, the wall member extends upward from the container; and in the compressed position, the wall member is at least substantially contained within the container and the upper portion of the wall member is below the locking member of the container. Moreover, when the wall member is compressed into its compressed position, the locking member moves radially inwardly, due to is inherent resiliency, to a locking position in which the locking member extends directly over the upper portion of the wall member and locks that wall member inside the container.

U.S. Pat. No. 5,269,428

Inventor: Neil Y. Gilbert

Issued: Dec. 14, 1993

A collapsible container having at least one helical preferential fold region that enables a user to gradually and fixedly increase or decrease the internal volume of the container. A cup section is used to act on the collapsible container to cause folding or unfolding of the collapsible container's side wall.

U.S. Pat. No. 5,322,166

Inventor: Jonathan M. Crowther

Issued: Jun. 21, 1994

A pill storage and dispensing container has a lower storage unit with a plurality of radially arranged individual pill storage compartments. An upper storage unit positioned directly above and nestled within the lower unit also has a plurality of similarly arranged storage compartments as well as one bottomless compartment. A top cover is positioned directly above the upper storage unit, and a dispensing opening in the cover is arranged to communicate with the various compartments in the upper unit as well as with the bottomless compartment and the various compartments of the lower storage unit as the cover is rotated relative to the storage units. A hub shaft releasably interconnects the upper and lower storage units and the top cover while allowing the storage units and cover to rotate relative to on another. Twenty eight individual storage compartments are provided in a compact container which enables pills to be dispensed four times per day over a seven day period.

U.S. Pat. No. 5,549,213

Inventor: Edward S. Robbins, III, et al.

Issued: Aug. 27, 1996

A container and associated cap assembly includes a container body having an open upper end defined by an annular rim, the rim having a substantially horizontal uppermost edge surface and a radially outwardly and downwardly extending bevelled surface. The cap has a top wall, a radially outer depending skirt portion and a radially inner depending skirt portion. The skirt portions are connected radially by an internal cap surface which includes a first substantially horizontal surface portion extending radially away from the radially inner skirt; a second downwardly and outwardly inclined sealing surface portion, and a third radii used surface portion connected to the radially outer skirt. The second downwardly and outwardly inclined sealing surface is sealingly engageable with the beveled surface of the annular rim such that the substantially horizontal uppermost edge surface is axially spaced from the cap top wall upon full threaded engagement between said cap and said container body.

U.S. Pat. No. 5,782,372

Inventor: Marla Weiss, et al.

Issued: Jul. 21, 1998

A carrying case which can be opened or collapsed is disclosed. The carrying case has at least a first nestable module and a second nestable module. The first module has a bottom portion which has an inward projection. A side portion of the first module has a compartment which can be withdrawn from the first module. A second module has a top portion which has an outward projection and a side portion of the second module has a compartment which can be withdrawn from the second module, wherein the outward and inward projections of the first and second modules cooperate as a stop means for controlling the opening of the carrying case. The first and second modules are nestable within one another and are adapted to slidably collapse into one another and slidably open into a position to provide access to the compartments.

U.S. Pat. No. 6,105,815

Inventor: Masayosi Mazda

Issued: Aug. 22, 2000

A port closure is a combination which includes a tank, a closure member and an actuator. The tank has defining walls, an exterior surface, an interior surface, an interior cavity and an access port. The closure member is disposed within the interior cavity of the tank. The closure member has an access port engaging face that is larger than a cross-sectional area of the access port. The actuator is coupled with the closure member and moves the closure member between a first position in which the access port engaging face closes the access port and a second position laterally spaced from the access port.

U.S. Pat. No. 6,126,010

Inventor: Robert A. Kogen

Issued: Oct. 3, 2000

A combination pill dispenser and collapsible drinking cup unit. The unit includes an elongated hollow body, a first removable cap member, a second removable cap member, a pill organizer, and a collapsible cup. The hollow body has an outer wall including opposed first and second ends and an end wall located adjacent the first forming a hollow chamber in which the pill organizer is located. A first removable cap is provided to close the chamber in which the organizer is located. The organizer includes a plurality of wedge-shaped compartments formed by plural wall panels radiating outward from a central post. The post projects upward from a circular, planar base member. A circular, planar cover is rotatably mounted on the post and includes a wedge shaped opening in its periphery. The opening is arranged to selectively communicate with a respective one of the compartments when the cover is rotated to a desired orientation. The second cap member has an end wall and a peripheral flange, and is arranged for releasable securement to the first end of the hollow body. The collapsible cup is located on the end wall of the second cap member and within the bounds of the peripheral flange. The collapsible cup is formed of plural conical shaped sections which are nested together and arranged to be moved from the nested position to an extended position to form a leak-proof cup.

U.S. Pat. No. 6,202,224

Inventor: Ronald A. Freeman

Issued: Mar. 20, 2001

A portable container for disposing of liquid waste products is disclosed having an expandable container into which an impermeable liner is inserted. The liner is secured to the container to prevent spillage and leaks. Furthermore, a water soluble gel pack is placed in the liner such that when a liquid waste product is deposited into the liner, the water soluble gel pack dissolves and the gel powder contained therein reacts with the liquid waste product thereby transforming it into a gel form, a solidified waste product, for easy disposal. The liner containing the solidified waste product is removed from the expandable container and disposed of by conventional means, enabling in the expandable container to be reused with a new liner and water soluble gel pack.

U.S. Pat. No. 6,293,403

Inventor: Douglas A. Holmberg

Issued: Sep. 25, 2001

A system to organize, store and dispense a plurality of tablets in a predetermined therapeutic regime comprising a plurality of sets of separate packets corresponding to the days of the week or the dates of the month configured to store at least one tablet therein wherein each set of separate packets comprises a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date.

U.S. Pat. No. 6,736,285

Inventor: Theo A. Stewart-Stand

Issued: May 18, 2004

A floral container sized to contain a flower pot or a growing medium and a plant, the floral container having a base and a detachable upper portion constructed in the configuration of an accordion fold which can be expanded vertically. The floral container may optionally have a skirt portion.

U.S. Pat. No. 6,898,899

Inventor: Donald E. Weder

Issued: May 31, 2005

A floral container sized to contain a flower pot or a growing medium and a plant, the floral container having a base and a detachable upper portion constructed in the configuration of an accordion fold which can be expanded vertically. The floral container may optionally have a skirt portion.

U.S. Pat. No. 7,004,324

Inventor: Lorraine Delorio

Issued: Feb. 28, 2006

A multi-compartment pill container constructed to hold a week's worth of medication for a user. The container has a housing having a top surface, a number of removable compartments held within the rectangular openings in the top surface of the housing, and a lid attached to the housing and extending over the compartments. Each compartment is divided into chambers by separation walls. Each chamber has a chamber cover on which indicia is printed. The indicia includes abbreviations for the days of the week for each of the compartments, as well as times of the day for each of the chambers. At the correct time, the user ingests the medication from the appropriate chamber. The container also includes a telescopic drinking cup to aid in the taking of medication and a timer to notify the user to take the medication. Each compartment may be completely removed from the housing to allow the user to carry the compartment separate from the entire container.

U.K. Patent Number GB294,187

Inventor: Arthur Cyril Hutt

Issued: Jul. 20, 1928

Tubes or containers, collapsable. —Relates to collapsable containers of the kind which are provided with a stiff outer casing, in order to avoid the shapeless and unsightly appearance of the container when partially empty. In the form shown in FIG. 1, the container is of annular cross section, having a rigid outer wall 10 and a collapsable inner wall 11, between which the material is enclosed. The inner wall is corrugated longitudinally, and can be distended outwardly towards the outer wall by means of a follower 14, in order to expel the material. A container of this form, having both walls collapsable, may be held in a stiff outer casing 19, FIG. 4, formed with a bulge 20, into which the outer wall of the container is forced when pressure is applied, so as to lock the two parts of the device together. A collapsable container 21, FIG. 5, of bellows form is provided with a deformable rib 22, which can be pressed into a groove at the upper end of a stiff outer casing 24. The container may comprise a flanged body part 25, FIG. 8, and a separate end-member 27, which can rest upon a shoulder 29 on a stiff outer casing 28. The rim of the casing is then turned over, so as to clamp the parts together. The collapsable container may be of telescopic form.

U.K. Patent Number GB557,857

Inventor: Cyril Everard Renton Coomber

Issued: Dec. 8, 1943

A collapsable container for liquids comprises a flexible collapsable body portion of rubber or rubberized canvas afforded by strip 3<SP>1<SP> connected by bands 3<SP>2</SP>, end members 1, 2 of similar but stiffer material one of them being provided with filling and vent openings, detachable stay members 4 adapted to be housed in sockets 6 and engaged by rings 5 attached to the corrugations to hold the container in distended condition and to be disposed together in a pair of similar sockets (not shown) provided on the end 1, to serve as a handle for the collapsed container, straps 8 being provided to hold the container in the collapsed condition.

U.K. Patent Number GB1,125,488

Inventor: Wilbert Joseph Gahm

Issued: Aug. 28, 1968

A collapsible container comprises a base member 10 to the base of which is secured a collapsible container made up of telescoping rings 11 which extend to form a cup (FIG. 5, not shown), and a cover 15 comprising a cup-shaped receptacle portion 16, closable by a cover 18 and in which pills &c. may be kept. The cover 18 is marked to co-operate with an index mark 17 on the wall of the receptacle 16 to indicate for example the time for taking the next pill.

U.K. Patent Number GB 2 376 877

Inventor: Austen Charles Miller

Issued: Dec. 31, 2002

Container 1 is formed from end pieces 2 and 3 rotated at 90 degrees relative to each other, spaced apart by six resilient rods 12 of carbon- or glass-fibre reinforced material. Textile panels 4-9 interpose the rods, and alternate panels are a gauze fabric to allow air movement. The rods locate in pockets 11 stitched on the hexagonal end pieces 2,3. Pushing the end pieces together in a twisting motion collapses the container into a planar configuration . . . . The textiles panels are wider at the middle than the ends, and form a skewed parallelogram. The hems between the panels are stitched with pockets 13 for the rods. A loop 15 can be provided to hang the container, and a hook 16 within can be used to hang items stored inside. A closure allows access to the interior. When extended, the container has a twisted bowed shape.

While these storage devices may be suitable for the purposes for which they were designed, they would not be as suitable for the purposes of the present invention, as hereinafter described. The present invention provides a bellows design collapsible polymeric storage tube having two lids. The device incorporates separate flexible plastic disks as segregating spacers that are dropped inside the device creating separate spaces for a plurality of items. The spacers lock into the widest part of the bellows securing them in place. The disks are printable/markable for promotional/informative media and labeling.

SUMMARY OF THE PRESENT INVENTION

A primary object of the present invention is to provide a collapsible bellows type storage tube.

Another object of the present invention is to provide a collapsible bellows type storage tube having two lids.

Yet another object of the present invention is to provide a collapsible bellows type storage tube having separate flexible plastic disks as segregating spacers that are placed inside the device creating separate spaces for a plurality of items to be placed within each chamber.

Still yet another object of the present invention is to provide a collapsible bellows type storage tube having segregating spacers that lock into the widest part of the bellows securing them in place. Additionally the disks can be used to form liquid tight segregated compartments with addition of a peripheral gasket.

Another object of the present invention is to provide a collapsible storage tube that consists of two threaded ends and two threaded lids that pop open and have their own separate chambers that also use a disk to create a separate space.

Yet another object of the present invention is to provide a collapsible storage tube that when the lid is empty the top of the lid collapses in upon itself thus saving space when the lid is empty and packed away.

Still yet another object of the present invention is to provide a collapsible storage tube that the body of the tube collapses inside in order to save space when stored away.

Another object of the present invention is to provide a collapsible storage tube having segregation disks having an irregular edge for aesthetic improvement Yet another object of the present invention is to provide a collapsible storage tube having segregation disks having tabs for easy removal from the tube.

Still yet another object of the present invention is to provide for a bellows receptacle having no exteriorly attachable lids, instead a pair of segregation discs are position within the bellows receptacle body approximate the top and bottom ends serving as receptacle closure.

Additional objects of the present invention will appear as the description proceeds.

The present invention overcomes the shortcomings of the prior art by providing a bellows design collapsible polymeric storage tube having two lids. The device incorporates separate flexible plastic disks as segregating spacers that are dropped inside the device creating separate spaces for a plurality of items. The spacers lock into the widest part of the bellows securing them in place. The disks are printable/markable for promotional/informative media and labeling. The collapsible bellows tube consists of two threaded ends and two threaded lids. The lids pop open and have their own separate space (s) that also uses a disk to create a separate segregated compartment. When a lid is empty the top of the lid collapses in upon itself thus saving space when the lid is empty and packed away, likewise the body of the tube collapses and expands as it is filled or emptied of the contents inside in order to save space when it is packed away.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
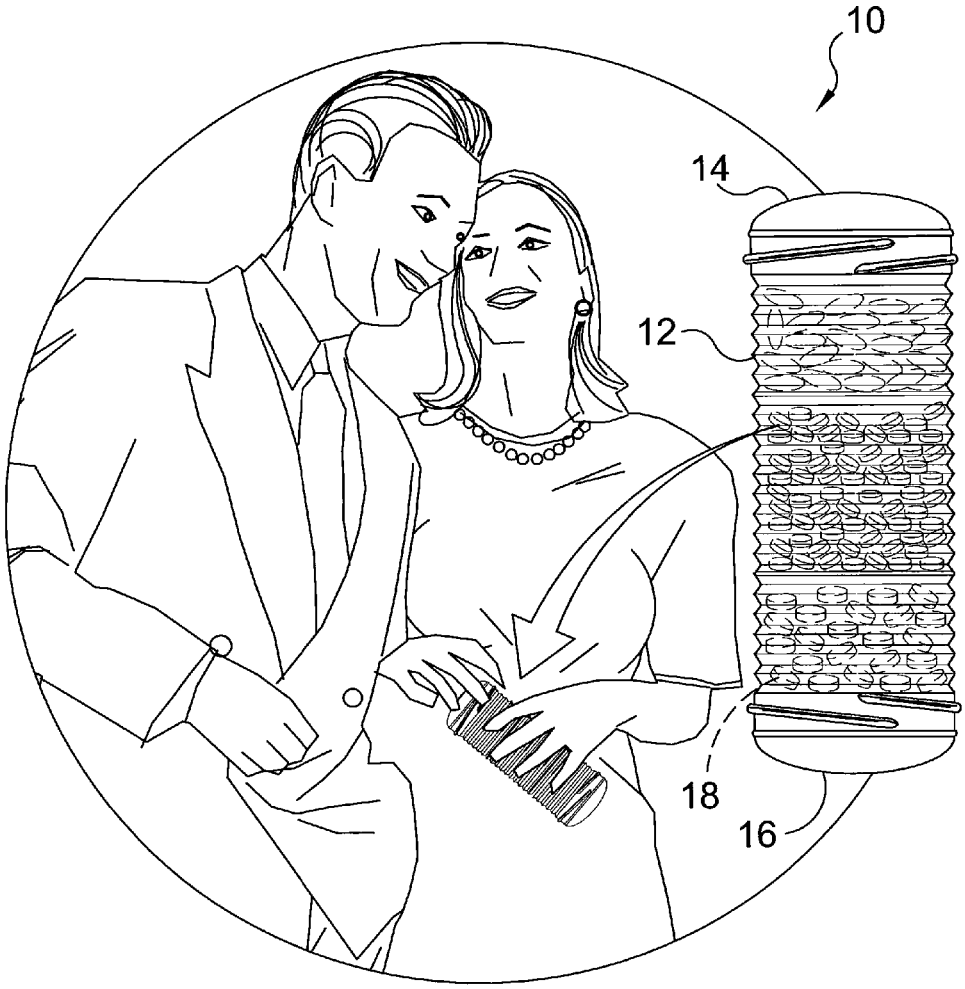
FIG. 1 is an illustrative view of the present invention in use.

Turning now descriptively to the drawings, in which similar reference characters denote similar elements throughout the several views, the figures illustrate the Collapsible Polymeric Storage Bellows Tube of the present invention. With regard to the reference numerals used, the following numbering is used throughout the various drawing figures.

10 Collapsible Polymeric Storage Bellows Tube of the present invention
12 collapsible tube body
14 top lid member
16 bottom lid member
18 contents
20 measure gradients
22 segregation disc
24 storage compartment
26 indicia
28 tab of 22
30 gasket of 22
32 solid contents
34 liquid contents
38 receiving groove
40 locking protrusion
42 expansion tube
44 male snap lock element
46 female snap lock element
48 mating threads
50 collapsing top of 14
52 daisy-shaped circumference of 22
54 buzzsaw-shaped circumference of 22
56 wave-like circumference of 22
58 flexible skirt portion of 22
60 rigid thickened base portion of 22
62 user

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a bellows design collapsible polymeric storage tube 10 comprising a substantially hollow body 12 having top 14 and bottom 16 lids providing access from either end. Additionally provided are a plurality of insertable spaces of varying designs for containing contents 18 therein dependant on use of the collapsible container 12, as illustrated throughout the accompanying figures. Further provided for are measurement gradients placed on the exterior container surface, which may included advertisement and/or logo graphics that may also occur on the insertable spacers.

Figure 2:
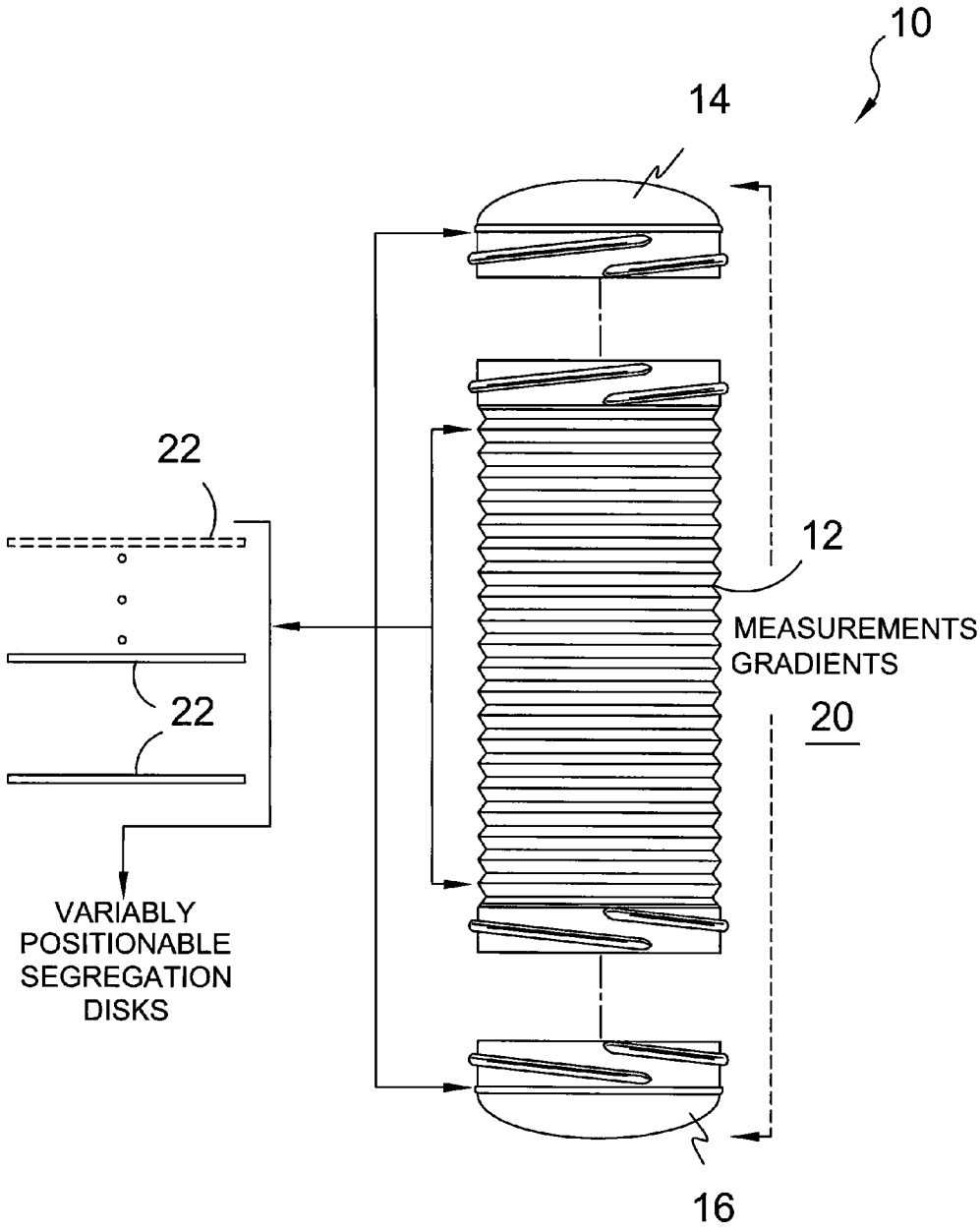
FIG. 2 is a side view of the present invention.

FIG. 2 is a side view of the present invention 10. The collapsible bellows tube body 12 consists of two threaded ends 20 and two threaded lids 14,16. The lids 14,16 unscrew and have spacer discs 22 to create a separate segregated removable compartment inside the lids 14,16 and within the body 12. When a lid compartment is empty the top of the lid collapses in upon itself thus saving space when the lid is empty and packed away, likewise the tube body 12 collapses and expands as it is filled or emptied of the contents inside in order to save space when it is packed away. Alternately provided for are measurement gradients 20 placed on the exterior surface.

Figure 3:
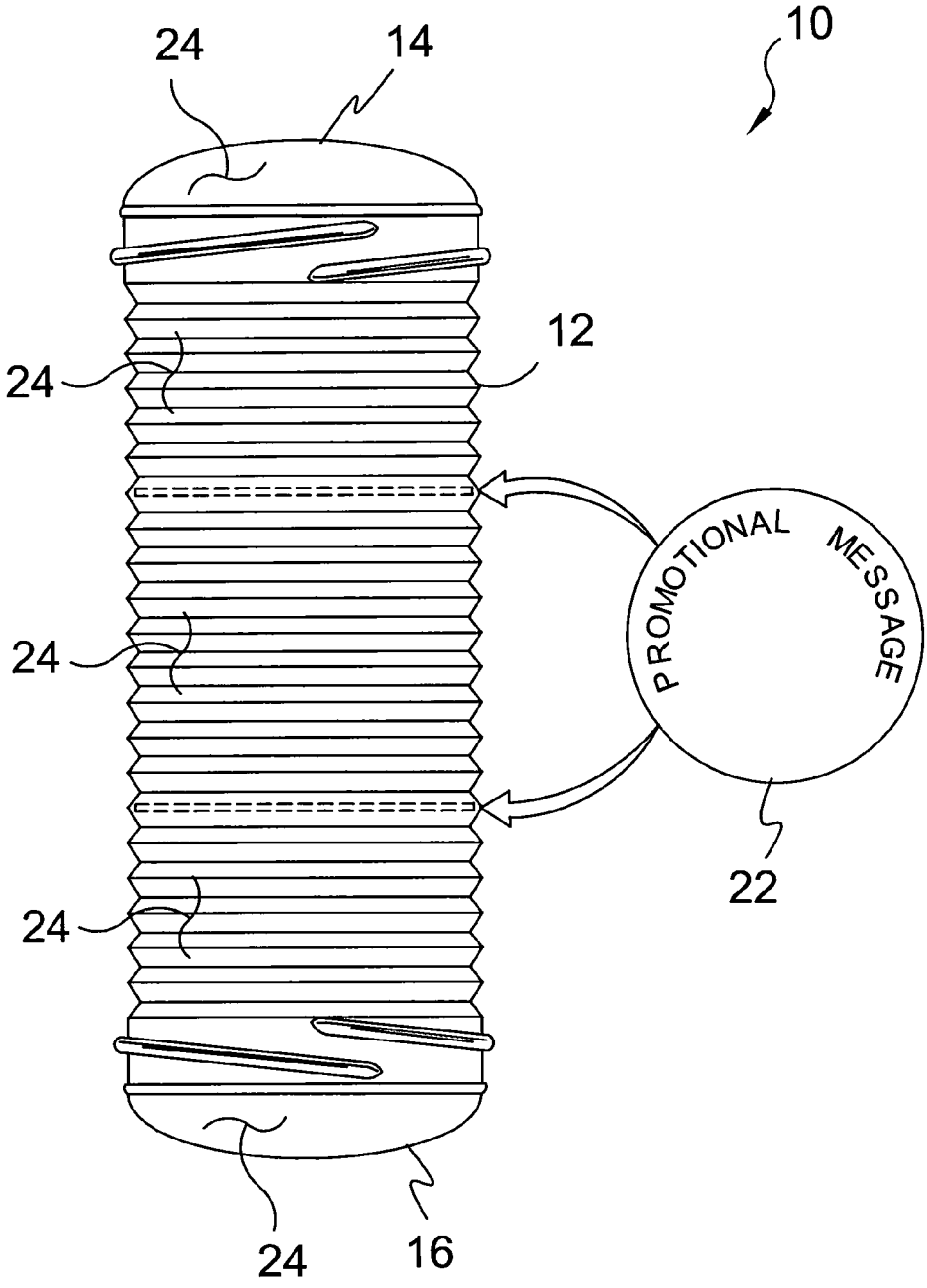
FIG. 3 is a side view of the present invention.

FIG. 3 is a side view of the present invention 10. The collapsible bellows tube container 10 is an improvement over storage jars and travel storage aids in that a multitude of separate items can be packed into one single tube 12. The volume segregation disks 22 create a plurality of storage compartments 24 when placed therein and are printable or markable for promotional or informative media indicia 26. The two lids 14,16 are designed to allow multiple access points to the contents stored therein.

Figure 4:
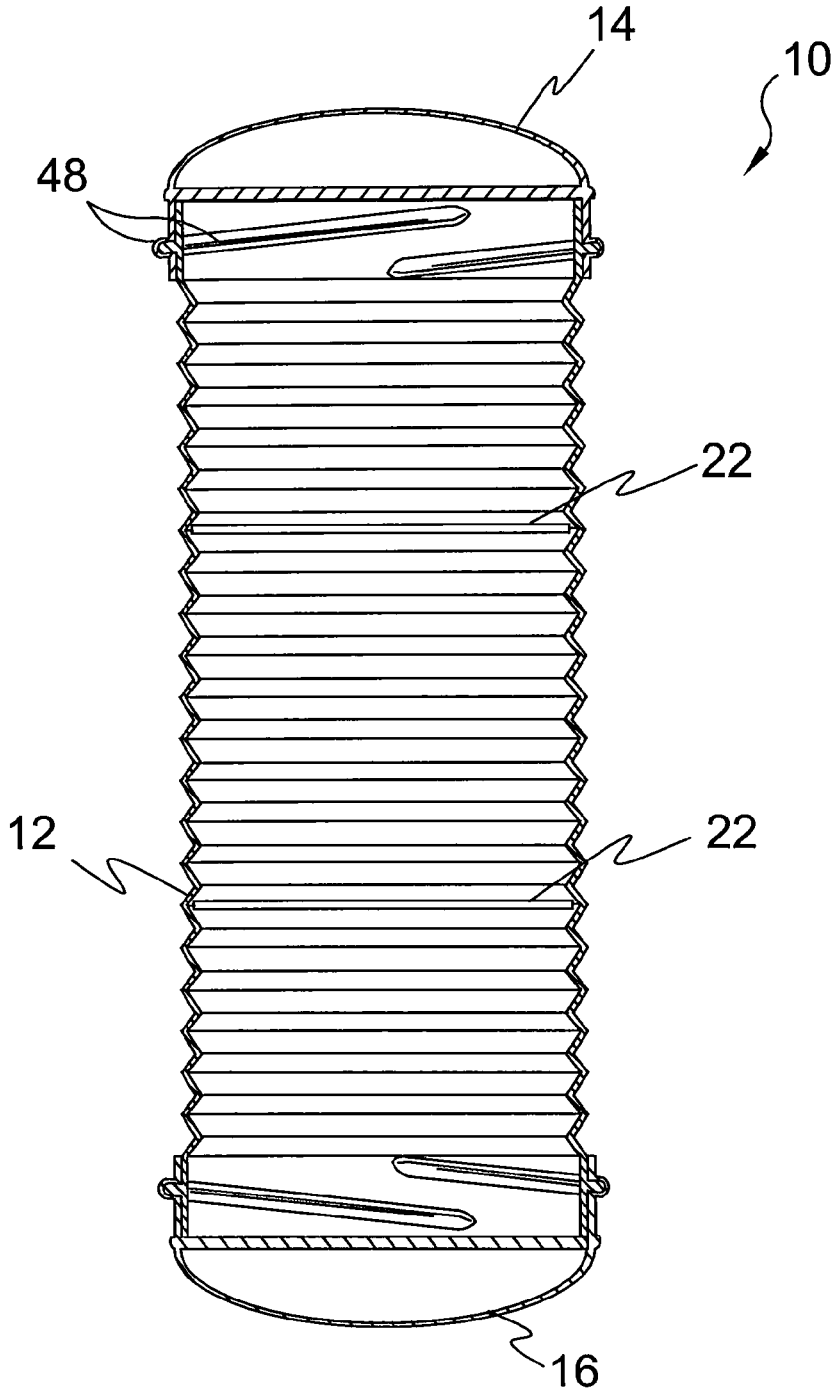
FIG. 4 is a sectional view of the present invention.

FIG. 4 is a sectional view of the present invention 10. The volume segregation disks 22 create a plurality of compartments when placed inside the tube and are printable or markable for promotional or informative media and labeling. The two lids 14,16 and the ends of the body 12 have mating threads 48 for securement thereto.

Figure 5:
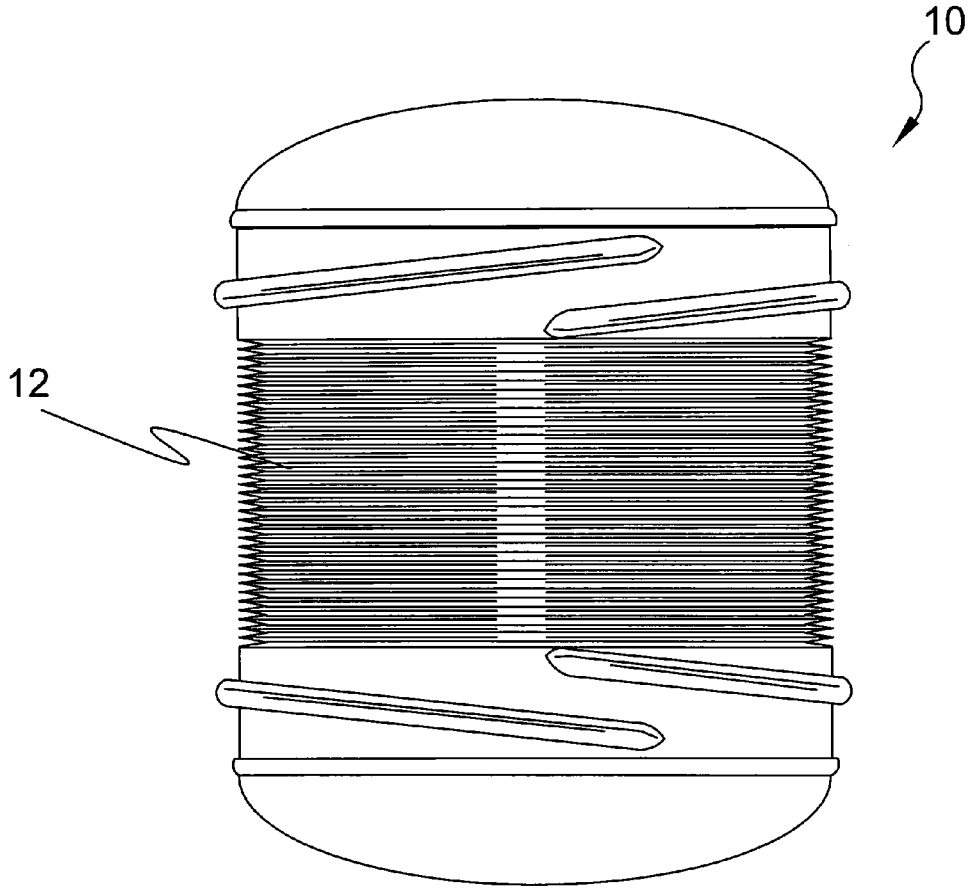
FIG. 5 is a side view of the present invention in a collapsed position.

FIG. 5 is a side view of the present invention 10 in a collapsed position. Shown is the collapsible bellows tube 10 in a collapsed position. The body 12 collapses and expands as it is filled or emptied of the contents inside in order to save space when it is packed away.

Figure 6:
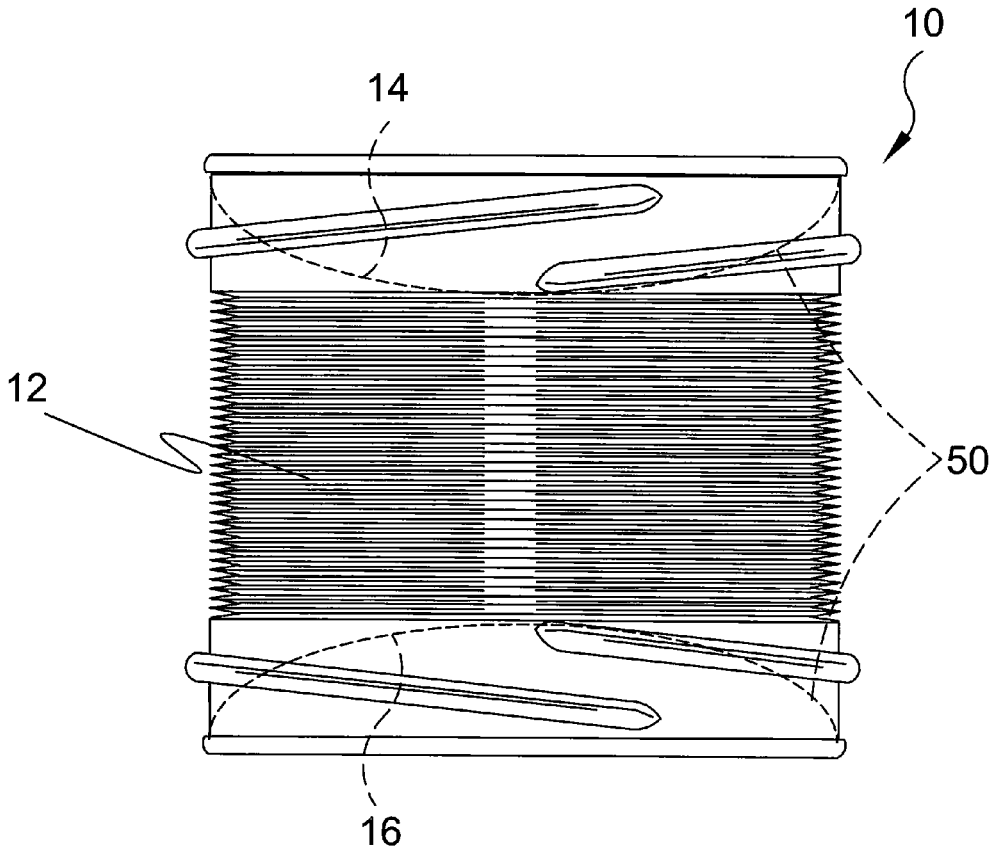
FIG. 6 is a side view of the present invention in a collapsed position.

FIG. 6 is a side view of the present invention 10 in a collapsed position. Shown is the collapsible bellows tube 10 with the body 12 in a collapsed position having the lids 14,16 also collapsed within the tube. When a lid 14,16 is empty the top of the lid 50 collapses in upon itself thus saving space when the lid is empty and packed away, likewise the body 12 of the tube collapses and expands as it is filled or emptied of the contents inside in order to save space when it is packed away.

Figure 7:
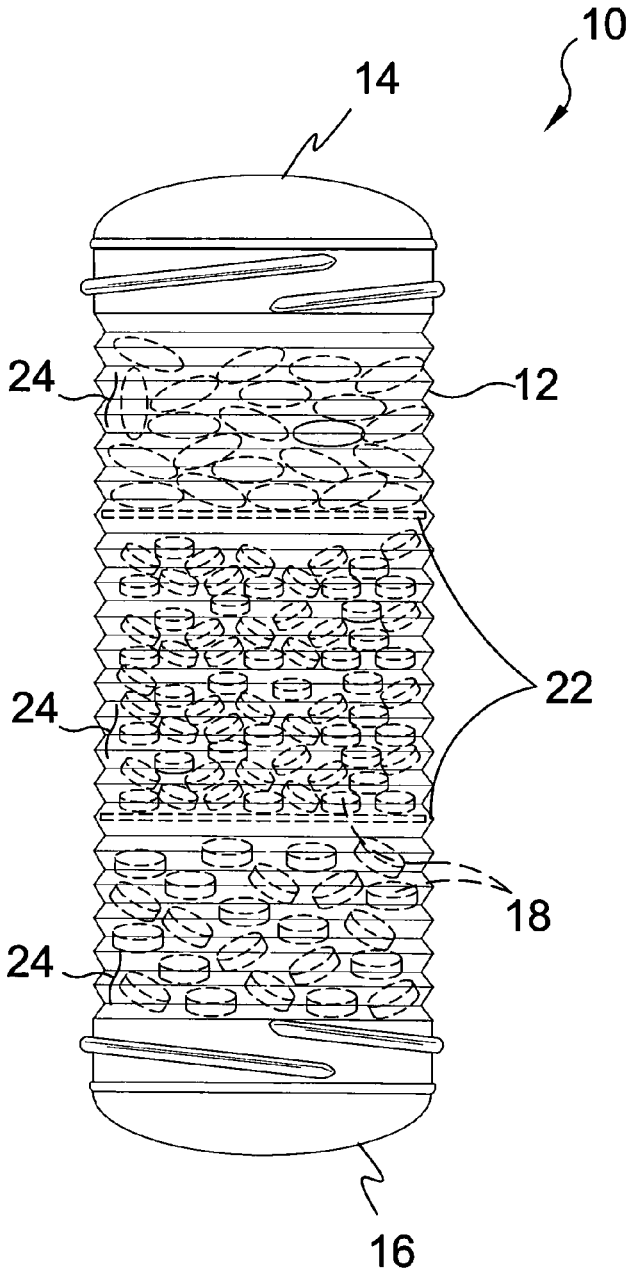
FIG. 7 is a side view of the present invention in use.

FIG. 7 is a side view of the present invention 10 in use. Shown is the collapsible bellows design storage tube 10 having two lids 14,16. The device incorporates separate flexible plastic disks as segregating spacers 22 that are dropped inside the device creating separate compartments 24 for a plurality varying content items 18. The spacers 22 lock into the widest part of the bellows body 12 securing them in place.

Figure 8:
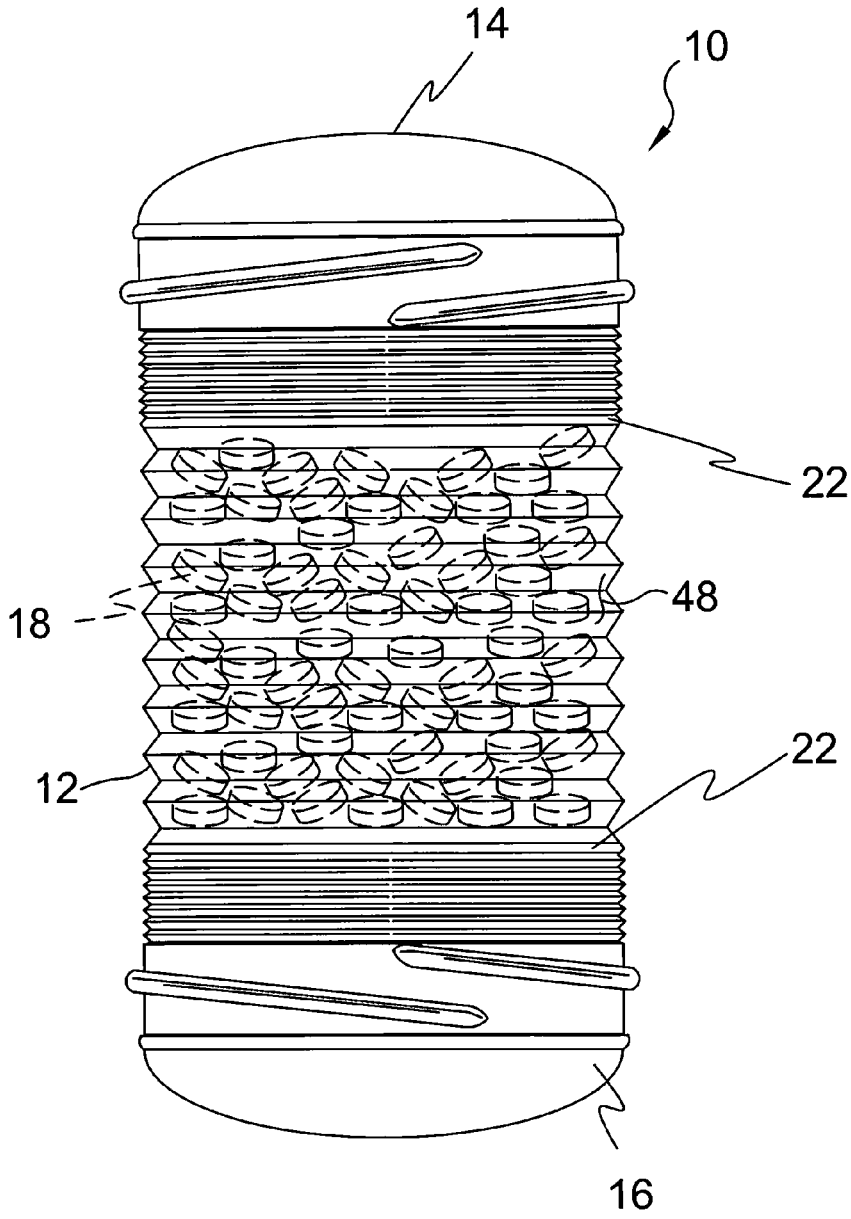
FIG. 8 is a side view of the present invention.

FIG. 8 is a side view of the present invention 10. The ends of the body 12 and the lids 14,16 have mating threads 48 for securing therewith. Shown are two segregation discs 22 employed therein forming a central storage compartment 24 filled with the stored contents 18 with the distal ends collapsed therein.

Figure 9:
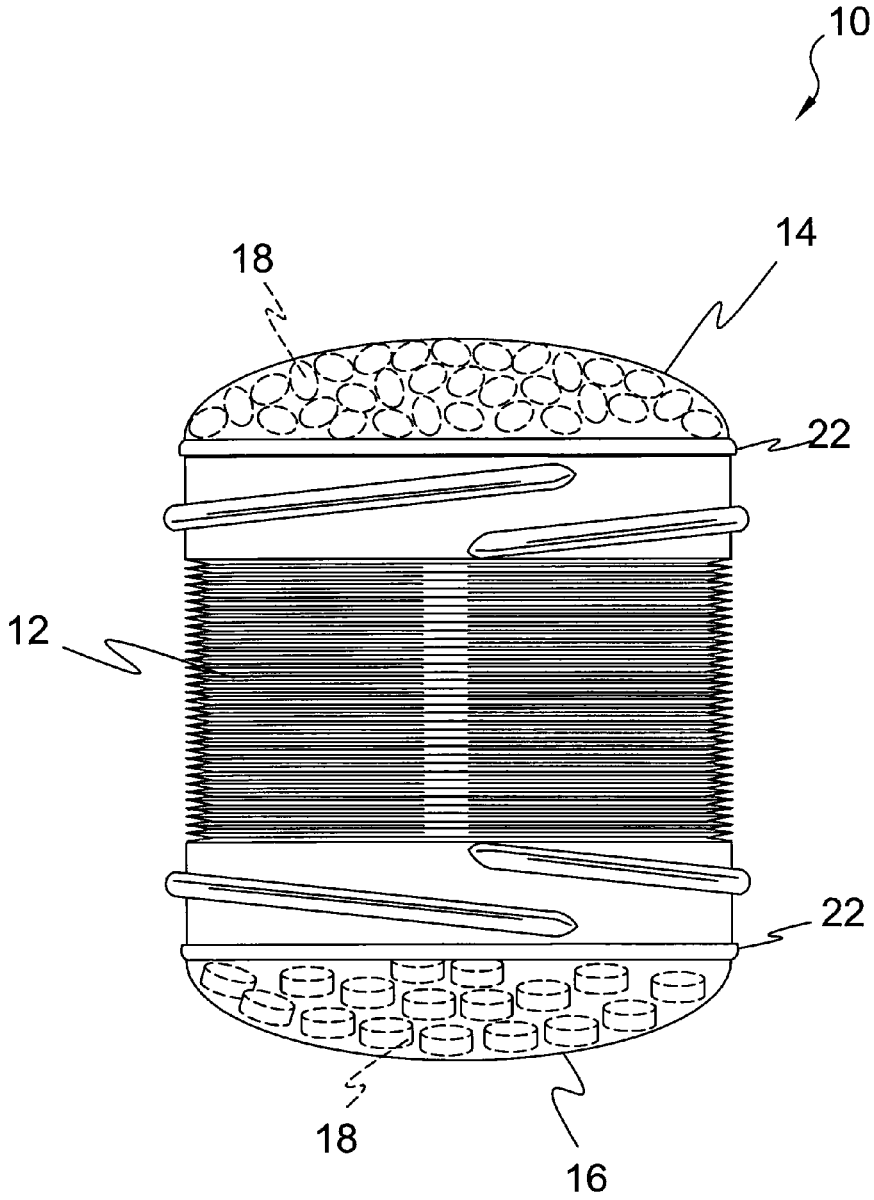
FIG. 9 is a side view of the present invention in a collapsed position.

FIG. 9 is a side view of the present invention 10 in a collapsed position. Shown is the bellows body 12 fully collapsed with the top lid 14 and the bottom lid 16 filled with their respective contents 18 and retained by segregation discs 22 disposed therein.

Figure 10:
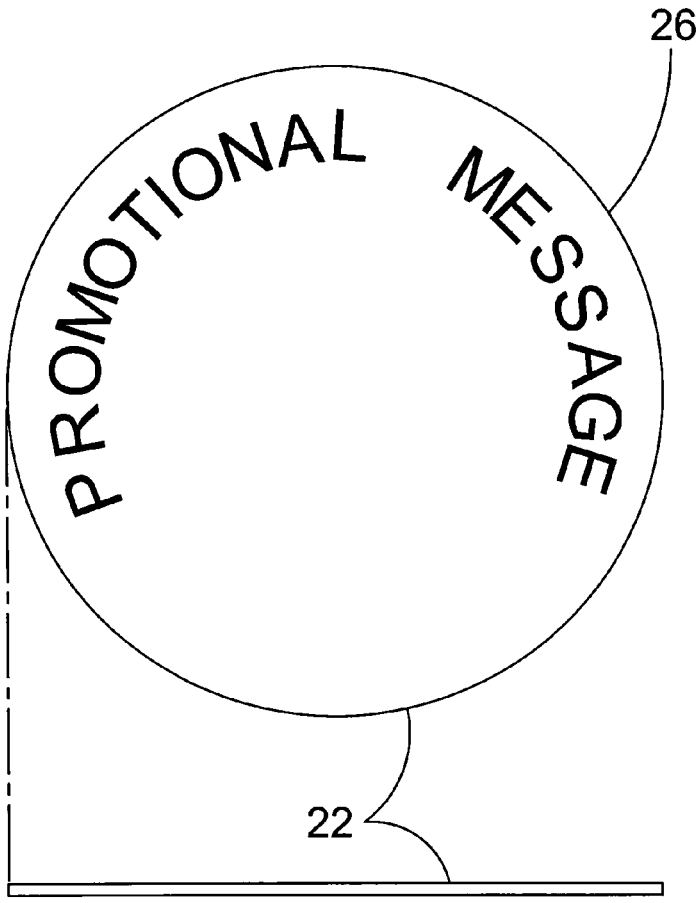
FIG. 10 is a side view of the present invention.

FIG. 10 is a side view of the segregation disc 22 with promotional indicia 26. The volume segregation discs 22 are used to create separate segregated compartments and are printable and markable displaying indicia 26 for promotional and informative media and labeling. These discs 22 lock into the widest part of the bellows, securing them in place.

Figure 11:
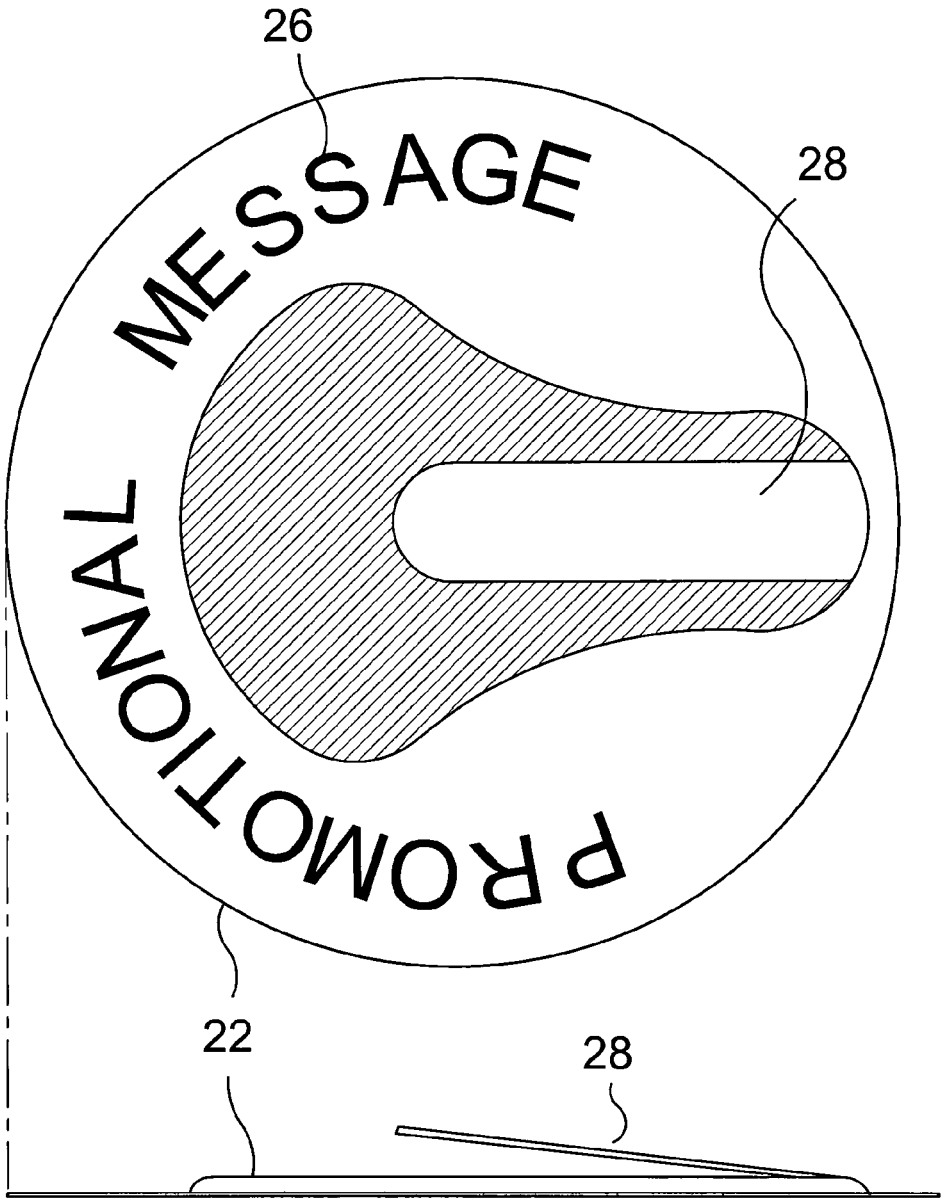
FIG. 11 is a side and top perspective view of the present invention.

FIG. 11 is a side and top perspective view of the segregation disc 22 having a pull tab 28 and promotional indicia 26. The volume segregation discs 22 are used to create separate segregated compartments and are printable/markable for promotional/informative media and labeling. These spacers lock into the widest part of the bellows, securing them in place. Additionally a pull tab 28*b* may be added to aid in the removal of the volume segregation disks.

Figure 12:
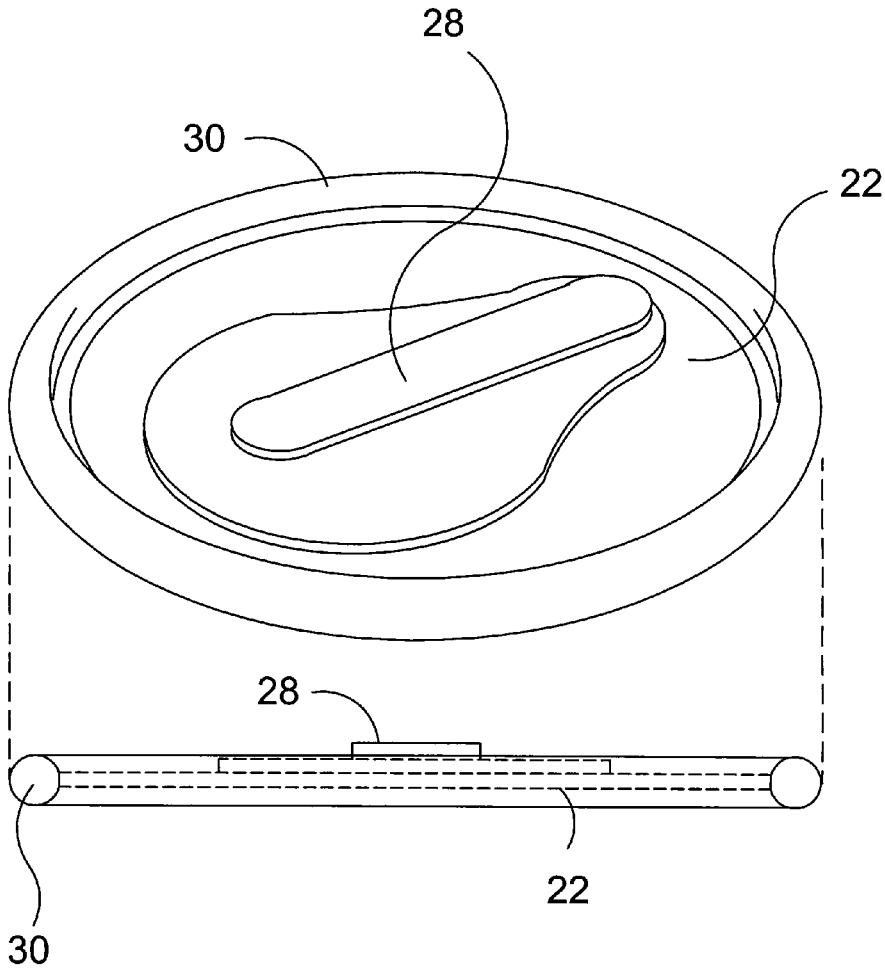
FIG. 12 is a perspective side view of the present invention.

FIG. 12 is a perspective side view of the segregation disc 22 having a pull tab 28 and a peripheral gasket 30 to make liquid tight seals between segregated portions of the apparatus when placed.

Figure 13:
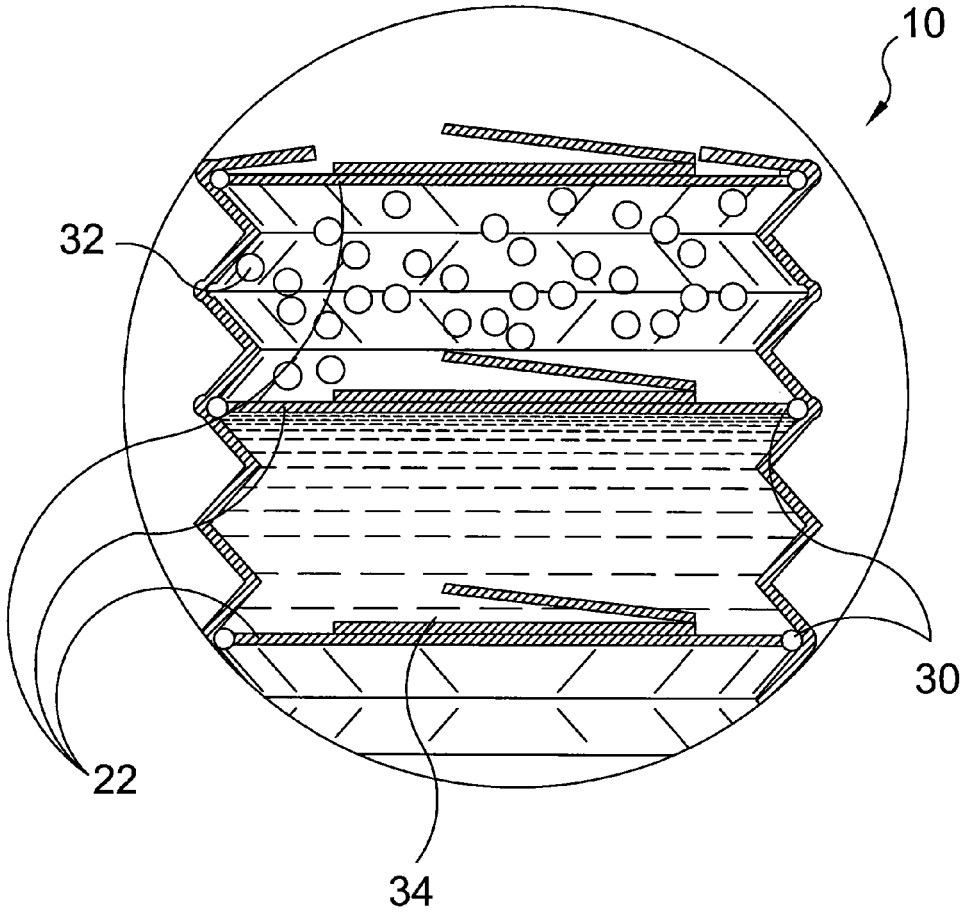
FIG. 13 is a sectional view of the present invention.

FIG. 13 is a sectional view of the present invention 10 utilizing the segregation disc 22 with a peripheral gasket 30 to separate stored solid contents 32 from the liquid contents 34 stored in the subjacent compartment.

Figure 14:
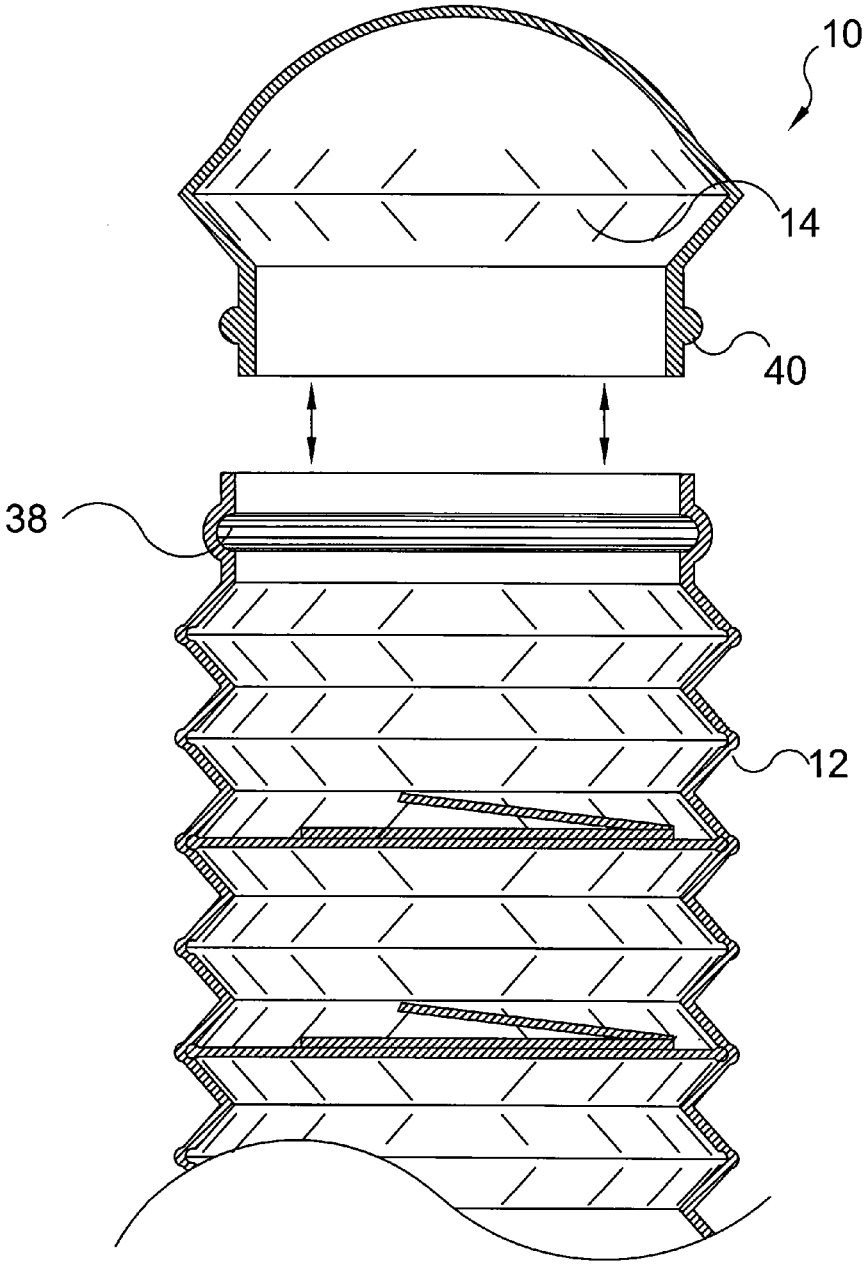
FIG. 14 is a sectional view of the present invention.

FIG. 14 is a sectional view of the present invention 10. Shown is the present invention having a top portion with a respective compressible lid 14 that may form a frictionally bound connection to the tube body 12 by compressing circumferential locking protrusion 40 into a mating receiving groove 38.

Figure 15:
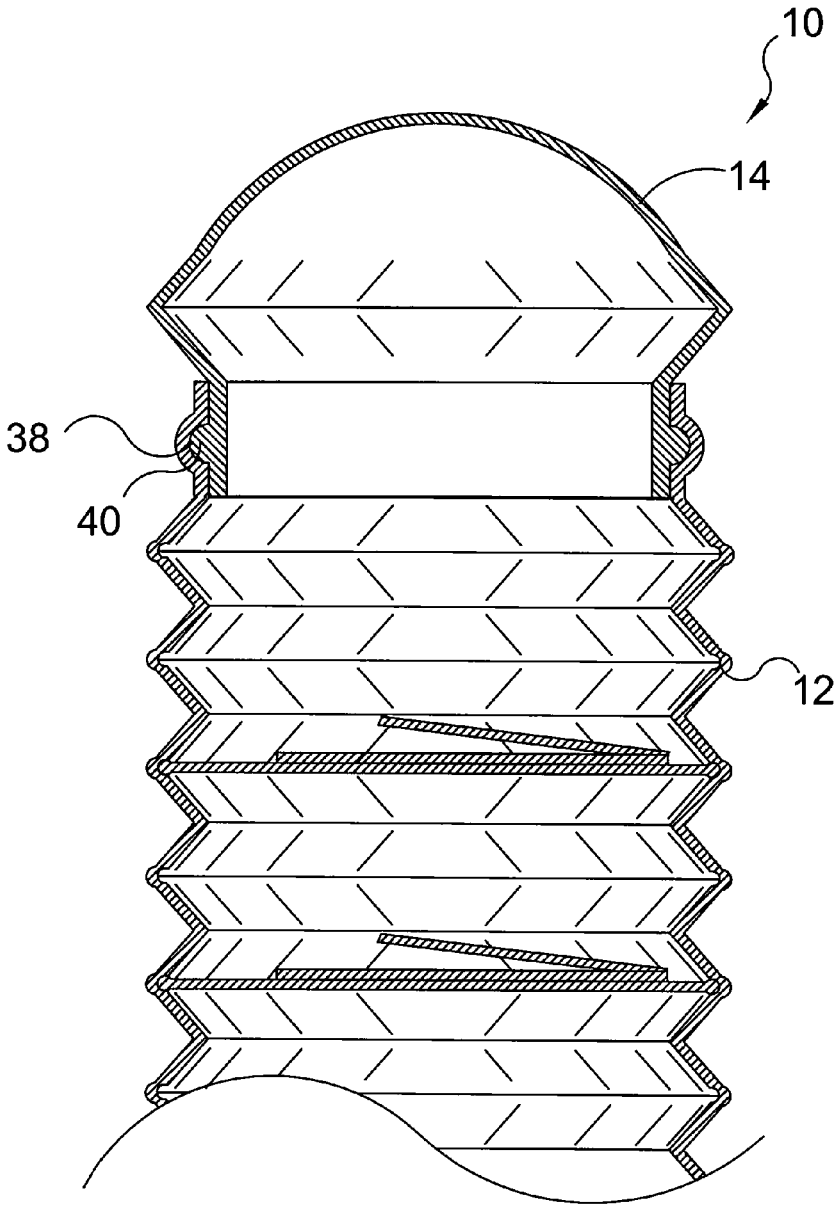
FIG. 15 is a sectional view of the present invention.

FIG. 15 is a sectional view of the present invention 10. Shown is the present invention having a top portion with a respective compressible lid 14 that may form a frictionally bound connection to the tube body 12 by compressing circumferential locking protrusion 40 into a mating receiving groove 38.

Figure 16:
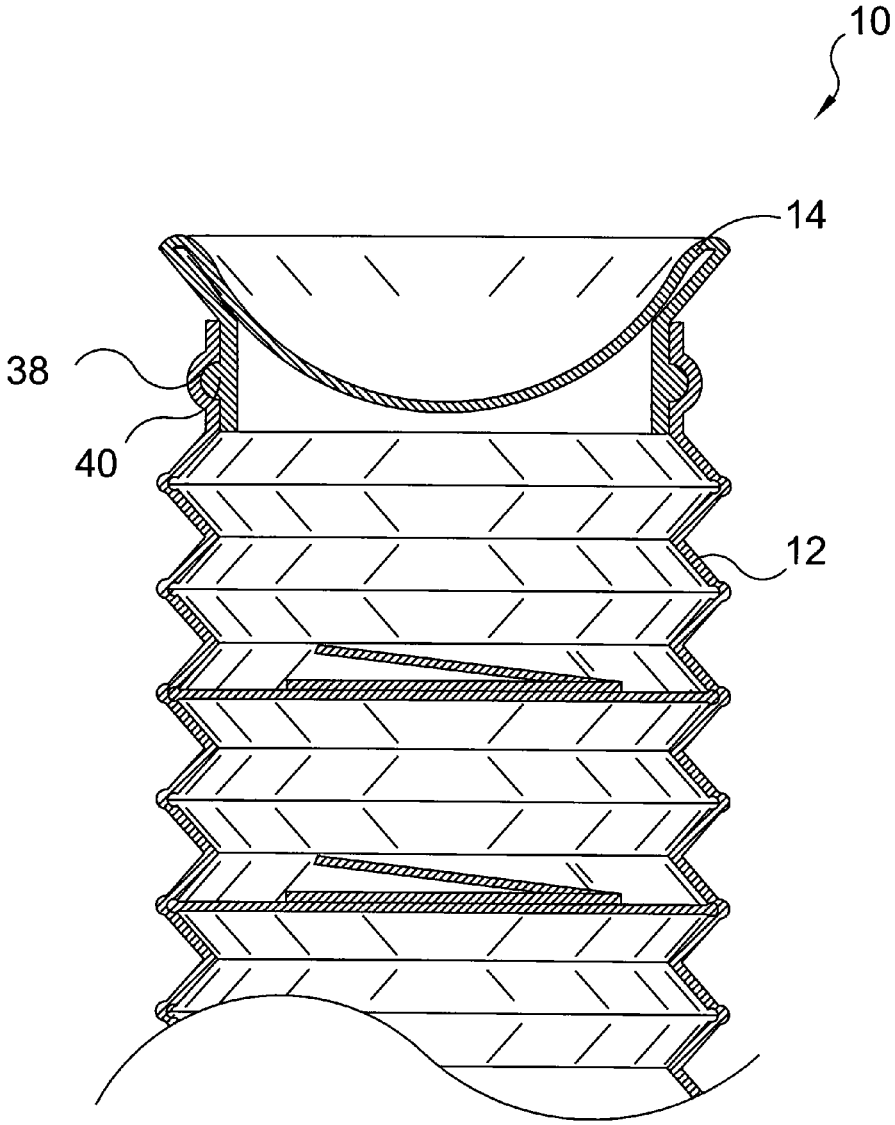
FIG. 16 is a sectional view of the present invention.

FIG. 16 is a sectional view of the present invention 10. Shown is the present invention 10 having a top portion with a respective compressible lid 14 that may form a frictionally bound connection compressing said locking protrusion 40 into a mating receiving groove 38. Additionally shown is the compressible lid portion compressed to reverse its dome into a concavity for reduction of size.

Figure 17:
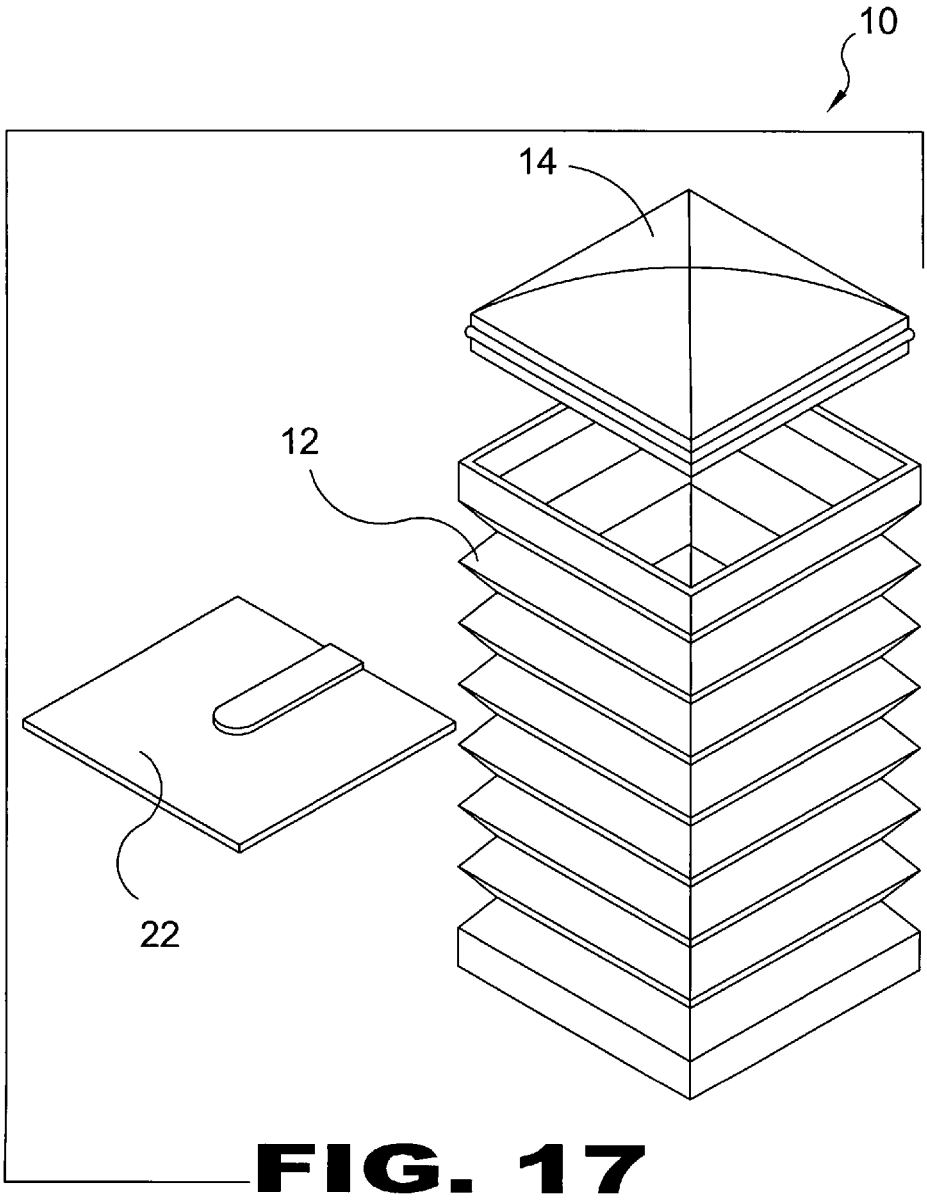
FIG. 17 is a perspective view of an additional element of the present invention.

FIG. 17 is a perspective view of an additional element of the present invention 10. Shown is the present invention 10 having the additional feature of the body 12 being constructed in an extending parallelogram configuration with respectively shaped segregation discs 22 and lid 14.

Figure 18:
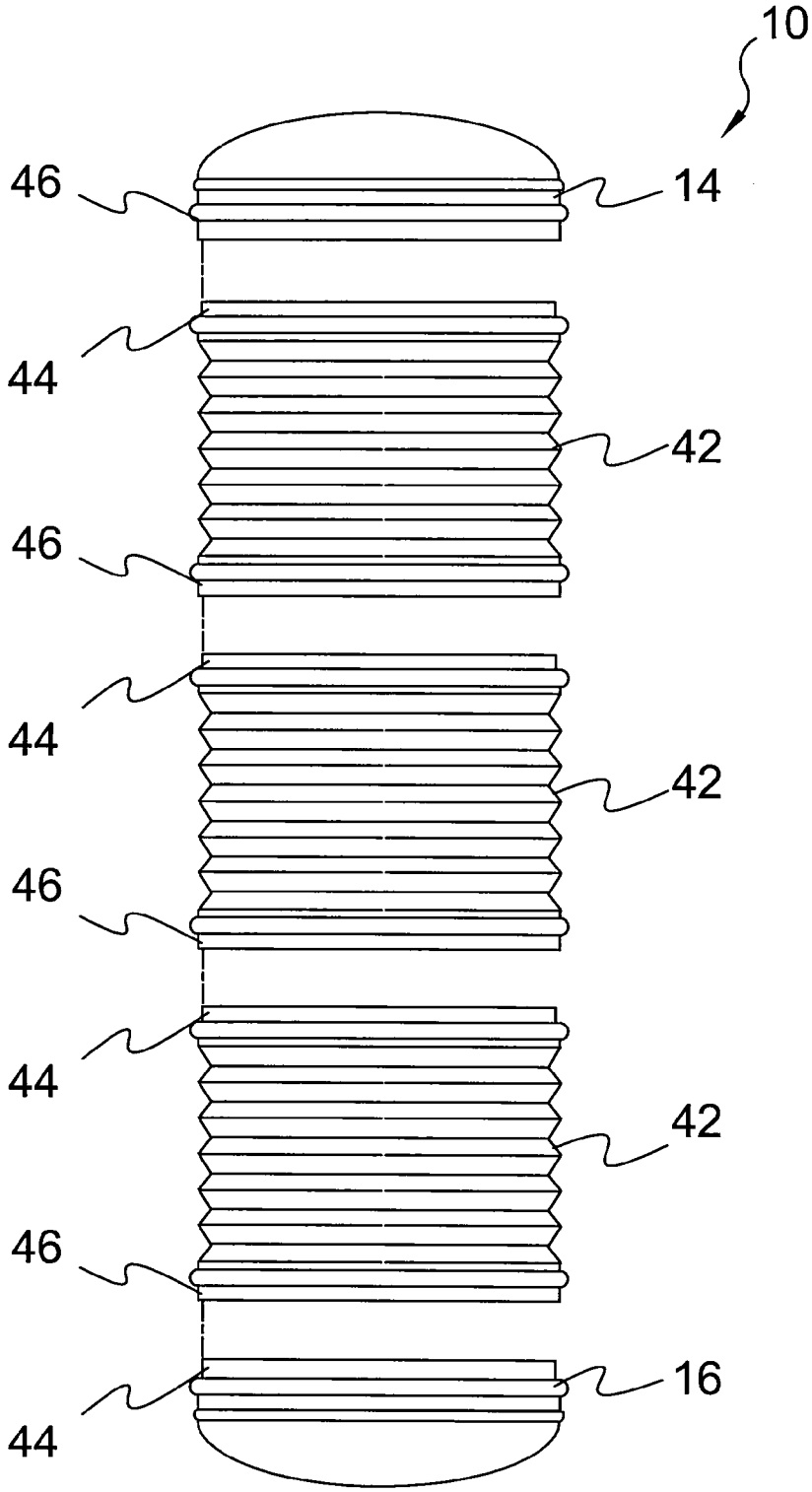
FIG. 18 is a side view of the present invention in use.

FIG. 18 is a side view of the present invention 10 in use. Shown is the collapsible bellows design storage tube having a tube assembly made up of tube expansion sections 42 that connect together in end-to-end fashion via mating male 44 and female 46 snap lock elements. The lids 14,16 and expansion tubes 42 are snap locked to an open or closed position.

Figure 19:
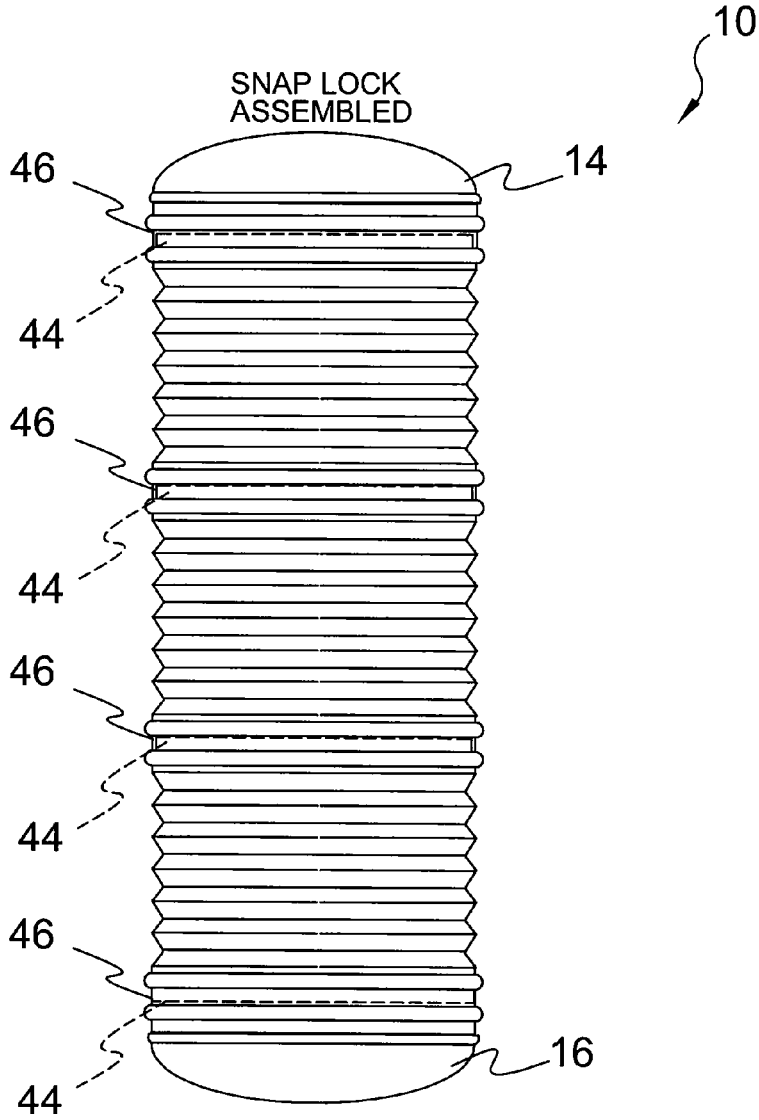
FIG. 19 is a side assembled view of the present invention in use.

FIG. 19 is a side assembled view of the present invention 10 in use. Shown is the collapsible bellows design storage tube having a tube assembly made up of tube expansion sections 42 connected together in end-to-end fashion via mating male 44 and female 46 snap lock elements. The lids 14,16 and expansion tubes 42 are snap locked to an open or closed position.

Figure 20:
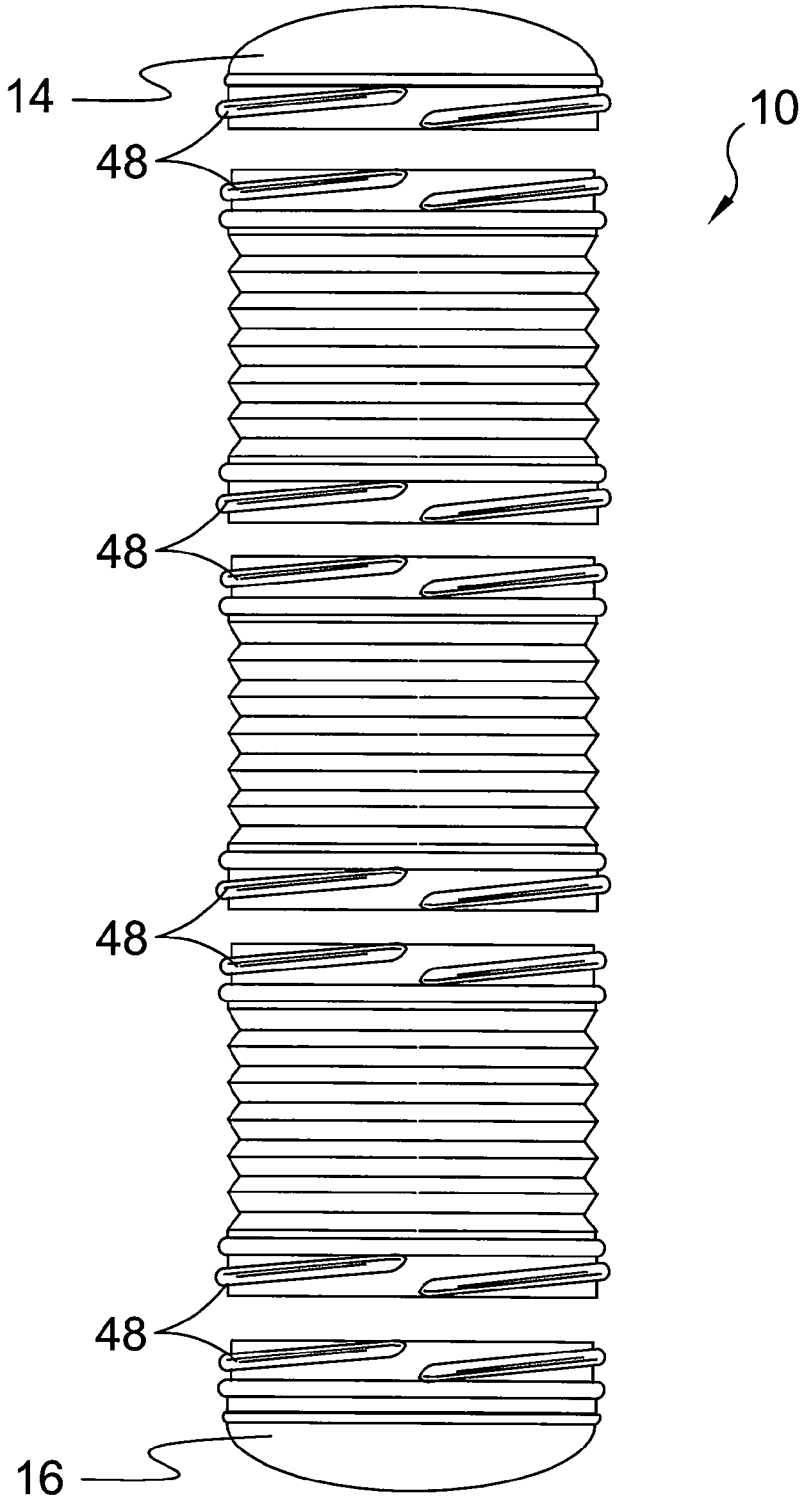
FIG. 20 is a side view of the present invention in use.

FIG. 20 is a side view of the present invention 10 in use. Shown is the collapsible bellows design storage tube having a tube assembly made up of tube expansion sections 42 that connect together in end-to-end fashion via mating threads 48. The lids 14,16 and expansion tubes 42 are snap locked to an open or closed position.

Figure 21:
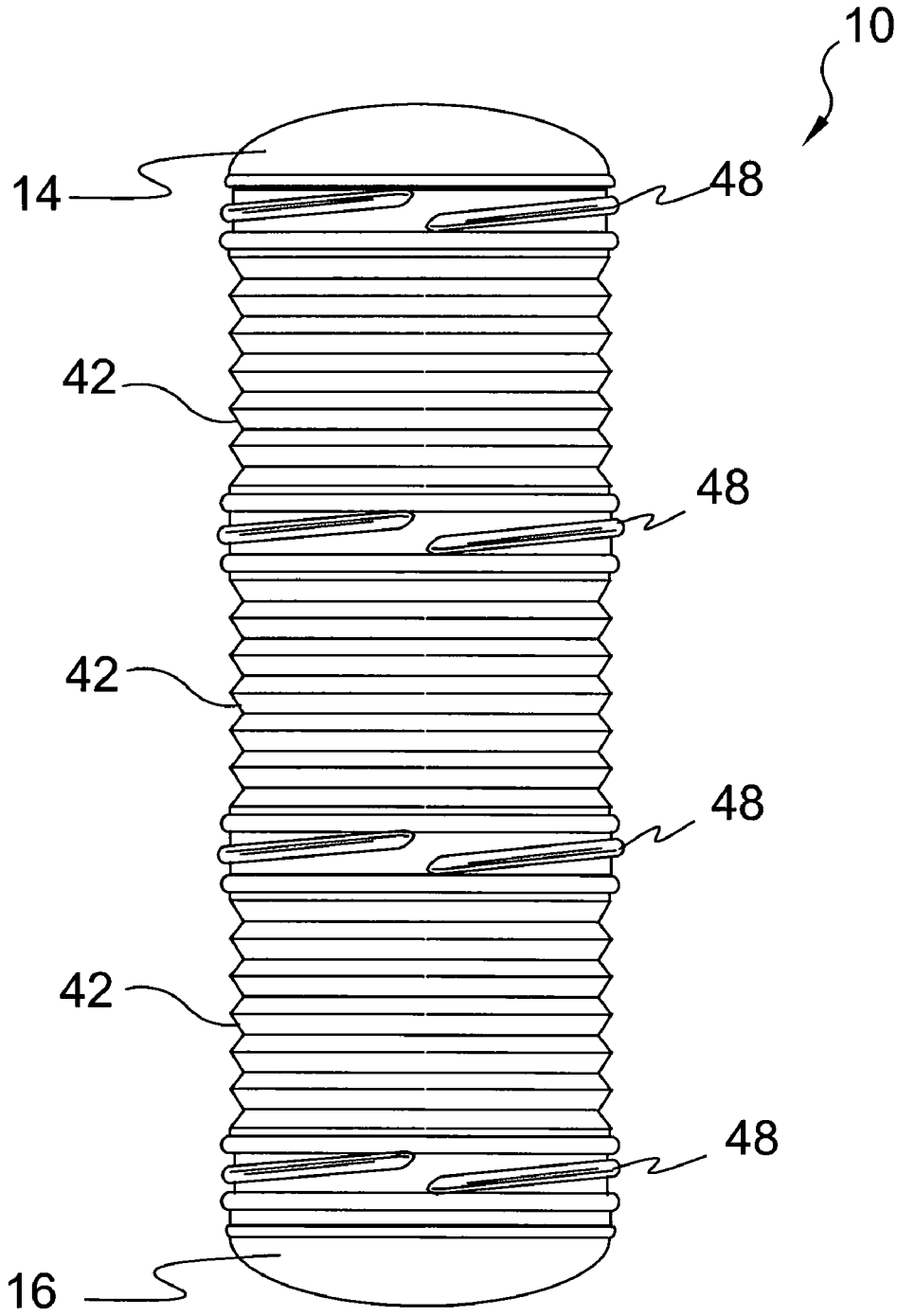
FIG. 21 is an assembled side view of the present invention in use.

FIG. 21 is an assembled side view of the present invention 10 in use. Shown is the collapsible bellows design storage tube having a tube assembly made up of tube expansion sections 42 that are connected together in end-to-end fashion via mating threads 48. The lids 14,16 and expansion tubes 42 are snap locked to an open or closed position.

Figure 22:
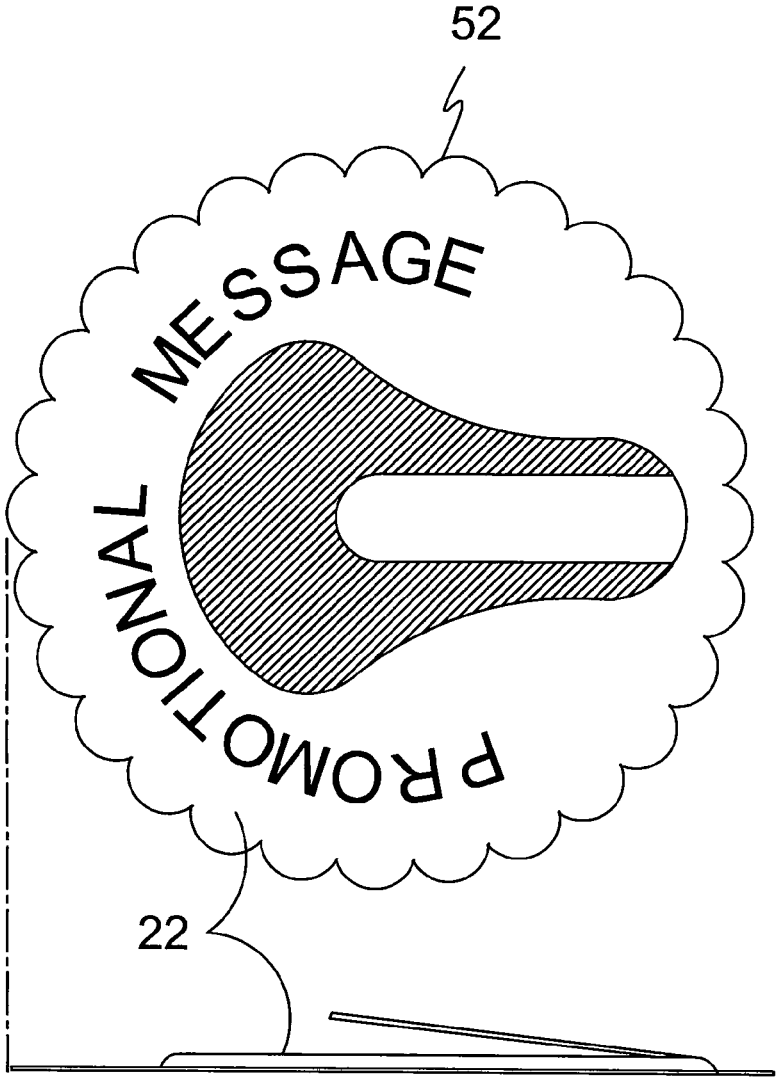
FIG. 22 is a side and top perspective view of an additional element of the present invention.

FIG. 22 is a side and top perspective view of an additional element of the present invention having a segregation disc 22 with a daisy-shaped circumference 52.

Figure 23:
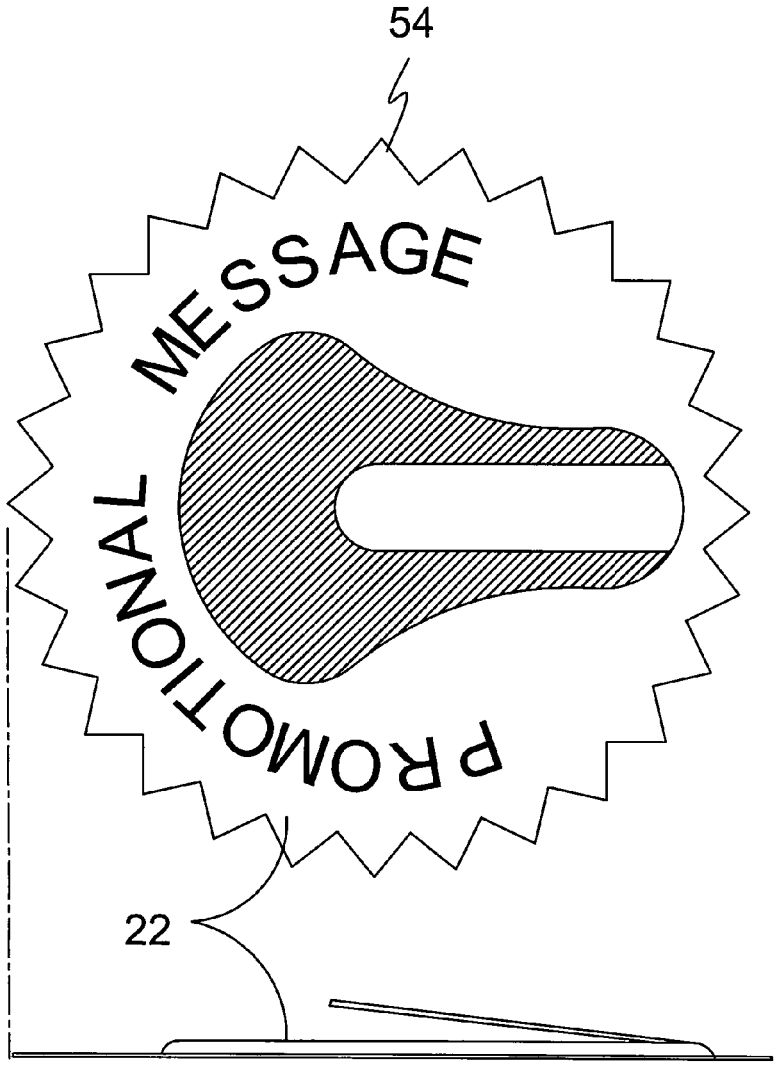
FIG. 23 is a side and top perspective view of an additional element of the present invention.

FIG. 23 is a side and top perspective view of an additional element of the present invention having a segregation disc 22 with a daisy-shaped circumference 54.

Figure 24:
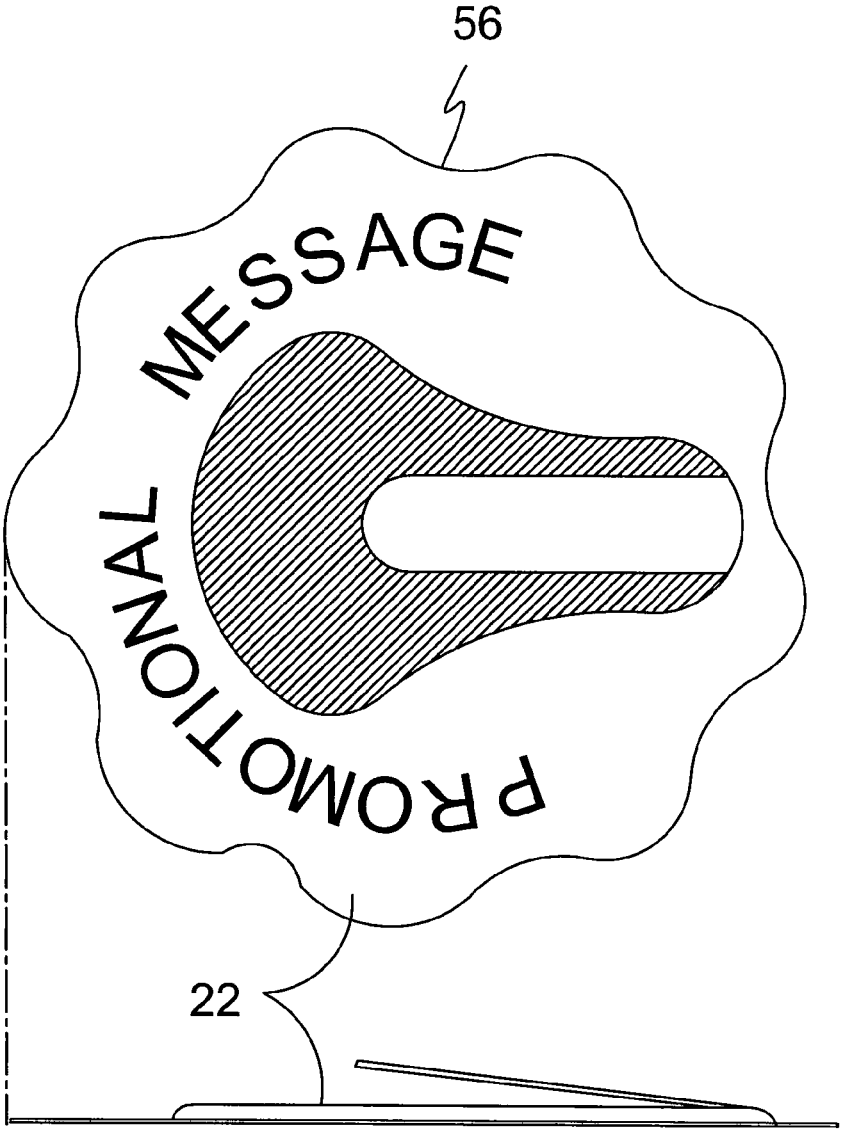
FIG. 24 is a side and top perspective view of an additional element of the present invention.

FIG. 24 is a side and top perspective view of an additional element of the present invention. Shown is an alternate embodiment of the segregation disc 22 used with the present invention whereby said disk is constructed having a wave like shape 56.

Figure 25:
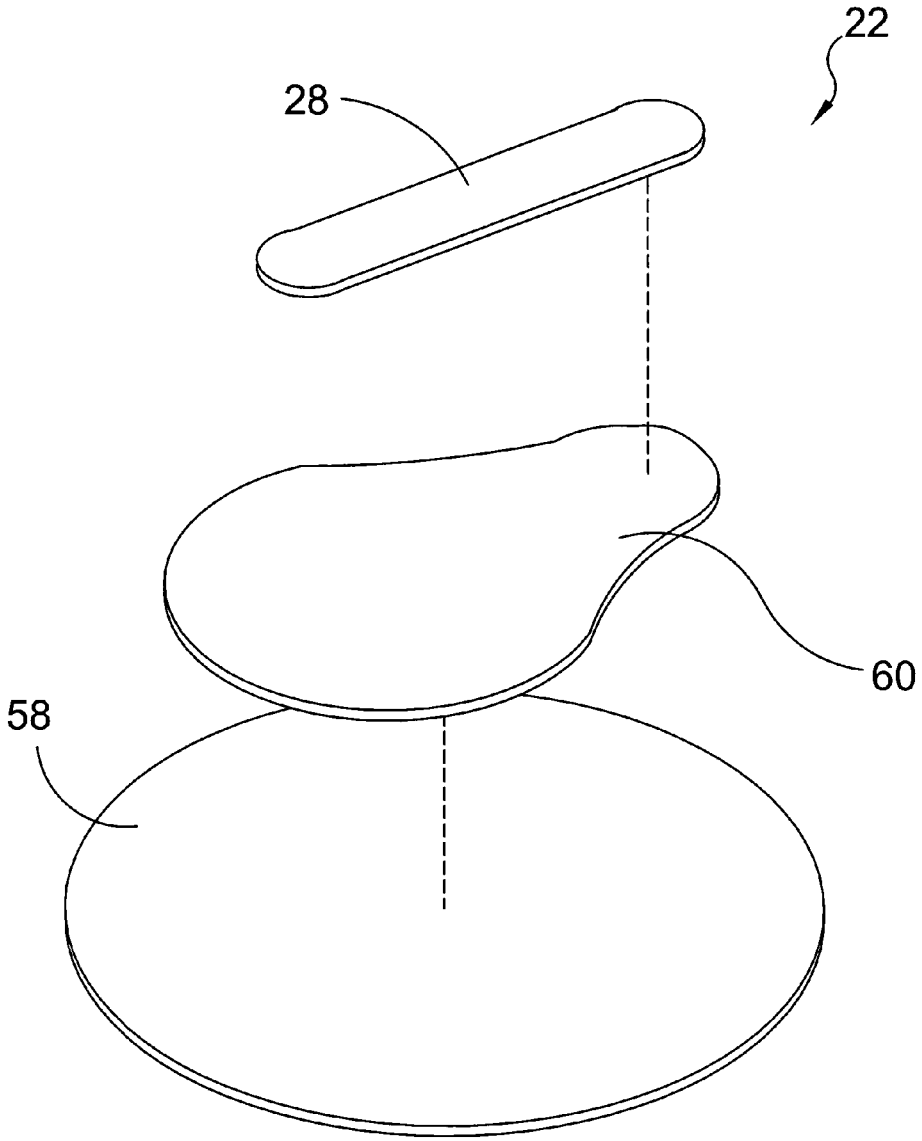
FIG. 25 is a perspective side view of the present invention.

FIG. 25 is a perspective view of an alternate segregation disc 22 having a plurality of distinct portions including a thin skirt portion 58 capable of being flexed and fit into an appropriate groove within the present invention, a thickened portion 60 to give the disk form while pinching or set in place, and finally a tab portion 28 for the removal of a disc 22 that has been priorly placed.

Figure 26:
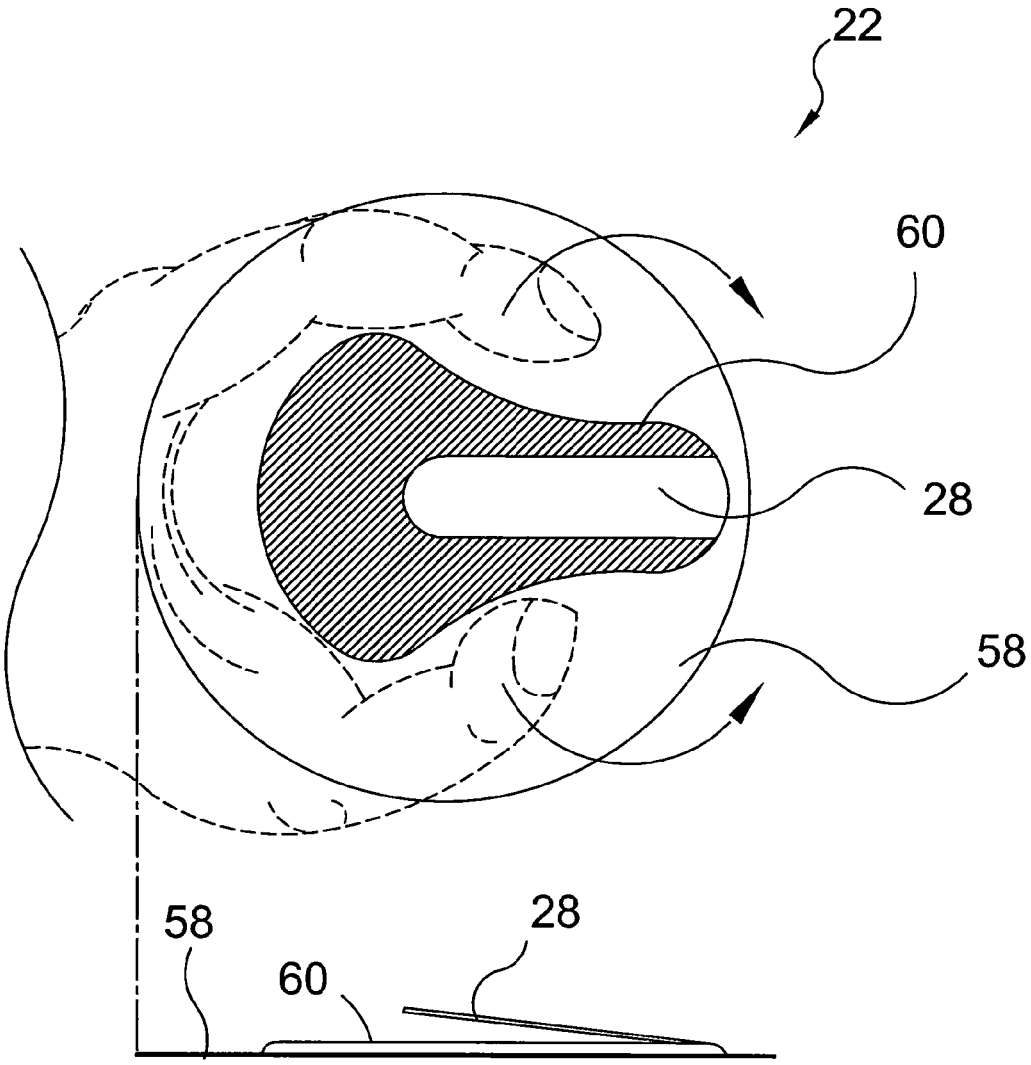
FIG. 26 is a side and top perspective view of the present invention.

FIG. 26 is a side and top perspective alternate segregation disc 22 having a plurality of distinct portions including a thin skirt portion 58 capable of being flexed and fit into an appropriate groove within the present invention, a thickened portion 60 to give the disk form while pinching or set in place, and finally a tab portion 28 for the removal of a disc 22 that has been priorly placed.

Figure 27:
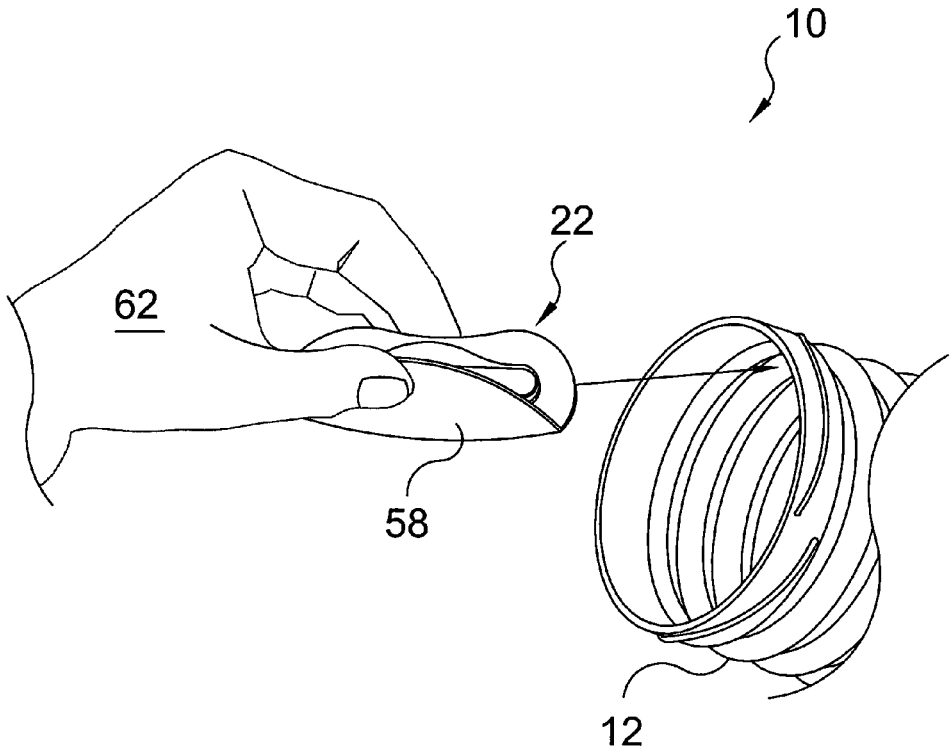
FIG. 27 is a perspective view of the present invention.

FIG. 27 is a perspective view of the present invention 10. Shown is the user 62 inserting a volume segregation disc 22 with a flexible skirt portion 58 into one of bellow indentations of the tube body 12 by folding the skirt 58 in a manner whereby the perimeter is reduced by deforming the disc 22 so as when released its returned form, forms a frictional seal.

Figure 28:
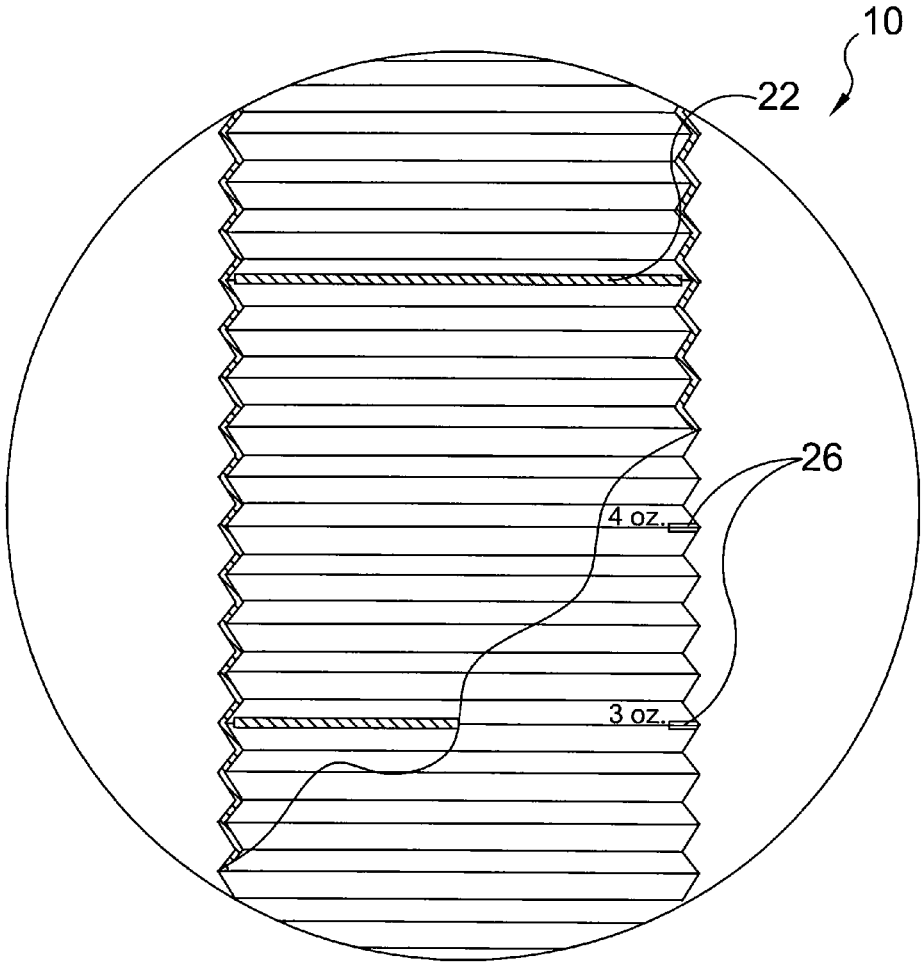
FIG. 28 is a sectional view of the present invention.

FIG. 28 is a sectional view of the present invention 10. Shown is the present invention 10 having volume segregation discs 22 used to create sealed compartments within the present invention with the additional element of indicia 26 being placed on the outside of the collapsible bellows tube body 12 so as to provide a means for measuring a contained fluid amount additionally the bellows of the collapsible compartments may be formed in a manner whereby each bellow is representative of a predetermined volumetric liquid amount.

Figure 29:
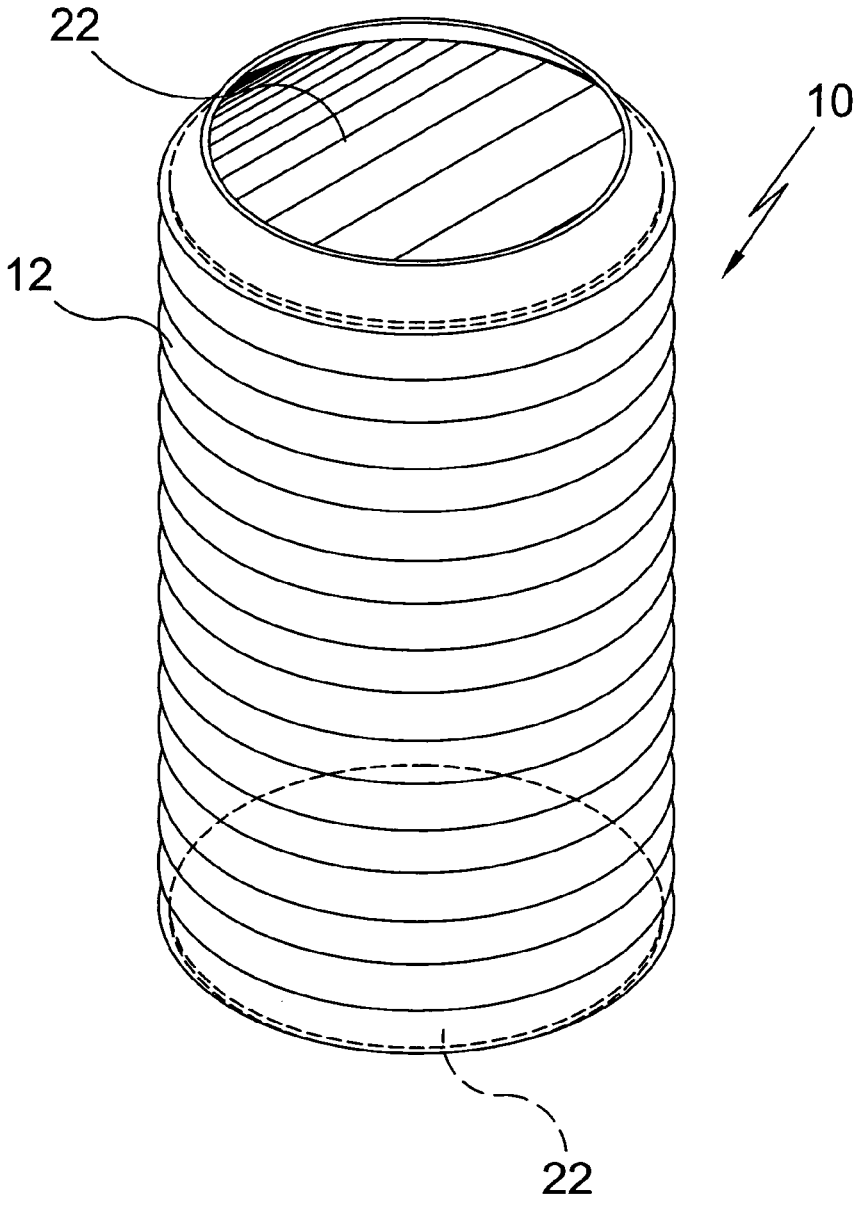
FIG. 29 is a perspective view of an additional element of the present invention.

FIG. 29 is a perspective view of an additional element of the present invention 10. The collapsible bellows tube body 12 has a plurality of segregation discs 22 positioned within the body and constrained thereby. As illustrated, a pair of disc positioned approximate the top and bottom end respectively create a single compartment without the need for the aforementioned screw on lids.

Figure 30:
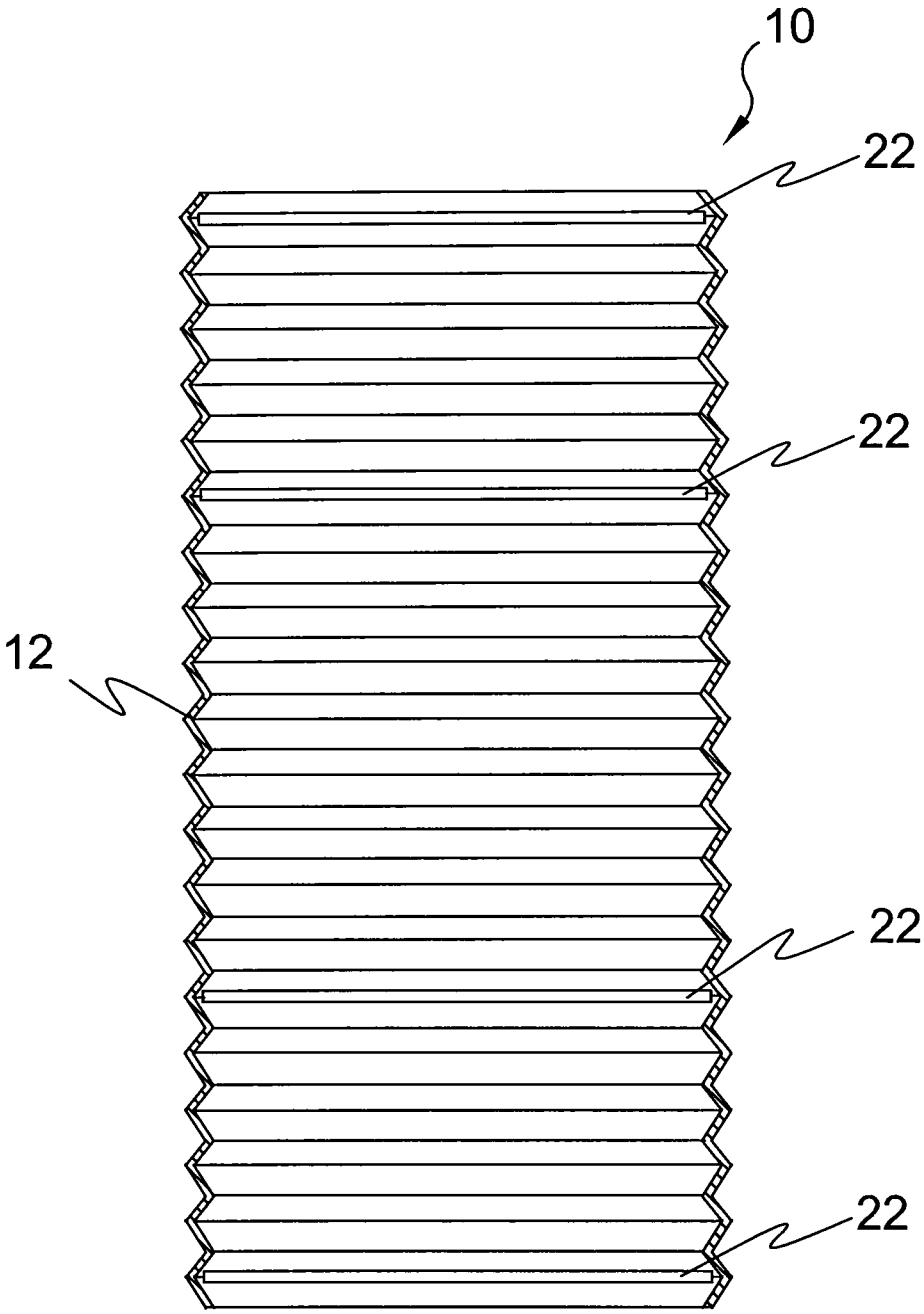
FIG. 30 is a sectional view of the additional element of the present invention.

FIG. 30 is a sectional view of the additional element of the present invention 10. Illustrated is the collapsible bellows tube body 12 having a plurality of segregation discs 22 positioned within the body and constrained thereby forming a plurality of segregated compartments. As aforementioned, one disc 22 is positioned approximate the top serving as lid on one end of the bellows container while another 22 is positioned approximate the bottom serving as the bottom lid with a plurality of segregation discs 22 positioned therebetween as desired by the user.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible polymeric storage bellows tube comprising:

a) a substantially hollow accordion-like bellows tube body having sidewalls with a symmetrical diagonally opposing zigzag configuration when viewed in profile with a top open end and a bottom open end that is expandable and collapsible upon itself to enable the user to adjust the length thereof accordingly;

b) a pair of selectively removable lid members securable to said ends of said tube body to provide access to the interior portion thereof wherein said lid members are resilient and respond to user manipulation and may be placed in concave and convex relation to said tube body as desired by the user for use as removable storage containers;

c) a plurality of segregation discs to be used to divide said tube into one and more separate compartments as determined by the user; and d) means for securing said lid members to said ends of said tube body.

2. The collapsible polymeric storage bellows tube recited in claim 1, wherein said segregation discs are substantially sized to be inserted into the selected grooves formed by widest spaced-apart exteriorly projecting interior V-shaped gaps defined by the zigzag profile and retained therein by the interiorly projecting walls thereof to form a segregating wall between two storage compartments.

3. The collapsible polymeric storage bellows tube recited in claim 1, wherein segregation discs are unnecessary when one single storage compartment is desired.

4. The collapsible polymeric storage bellows tube recited in claim 1, wherein at least one segregation disc is used to provide multiple storage compartments.

5. The collapsible polymeric storage bellows tube recited in claim 1, wherein said lid members are selectively and removably secured to said tube body ends with a frictionally bound connection having a mating locking protrusion and receiving groove.

6. The collapsible polymeric storage bellows tube recited in claim 1, wherein said lid members are in said convex configuration when used to store contents therein.

7. The collapsible polymeric storage bellows tube recited in claim 1, wherein a segregation disc is utilized to retain said contents within said lid member.

8. The collapsible polymeric storage bellows tube recited in claim 1, wherein said lid members are placed into said concave position as desired by the user when not in use.

9. The collapsible polymeric storage bellows tube recited in claim 8, wherein said segregating discs include a grasping pull tab projecting angularly for an off-center position therefrom to increase the ease of removal and insertion from said position within said tube body.

10. The collapsible polymeric storage bellows tube recited in claim 8, wherein said segregation disc further includes a peripheral gasket to provide a hermetic seal against said tube body to enable said storage compartment to securely retain fluids therein.

11. The collapsible polymeric storage bellows tube recited in claim 1, wherein said tube body is comprised of a plurality of interconnecting expansion tubes to further extend or retract the length thereof according to need.

12. The collapsible polymeric storage bellows tube recited in claim 11, wherein said expansion tubes are interconnected with mating male and female snap lock members disposed on the distal ends thereof.

13. The collapsible polymeric storage bellows tube recited in claim 11, wherein said expansion tubes are interconnected with mating male and female thread members.

14. The collapsible polymeric storage bellows tube recited in claim 1, wherein said segregation discs are circular in shape.

15. The collapsible polymeric storage bellows tube recited in claim 1, wherein said segregation discs have a daisy-shaped peripheral configuration.

16. The collapsible polymeric storage bellows tube recited in claim 1, wherein said segregation discs have a peripheral buzz-saw configuration.

17. The collapsible polymeric storage bellows tube recited in claim 1, wherein said segregation discs have a peripheral wave-like configuration.

18. The collapsible polymeric storage bellows tube recited in claim 2, wherein said segregation disc comprises:

a) a flexible skirt portion capable of being flexed into an appropriate groove of said tube body;

b) a central thickened base portion disposed on one side of said flexible skirt portion to give the disc form while pinching or setting in place; and c) a tab portion having a first end permanently secured to said thickened base portion in a centrally offset fashion.

19. The collapsible polymeric storage bellows tube recited in claim 1, wherein said tube body further includes a plurality of measure gradients for determining the quantity of the contents stored therein.

20. The collapsible polymeric storage bellows tube recited in claim 1, wherein said body and said related lids and segregation discs have a substantially parallel form relative to the top and bottom views thereof.

* * * * *